US010520151B2

(12) United States Patent
Ueki et al.

(10) Patent No.: US 10,520,151 B2
(45) Date of Patent: Dec. 31, 2019

(54) DAYLIGHTING APPARATUS

(71) Applicant: SHARP KABUSHIKI KAISHA, Sakai, Osaka (JP)

(72) Inventors: Shun Ueki, Osaka (JP); Shumpei Nishinaka, Osaka (JP); Toru Kanno, Osaka (JP); Daisuke Shinozaki, Osaka (JP); Hideomi Yui, Osaka (JP); Tomoko Ueki, Osaka (JP); Tsuyoshi Kamada, Osaka (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 15/520,174

(22) PCT Filed: Oct. 23, 2015

(86) PCT No.: PCT/JP2015/079984
§ 371 (c)(1),
(2) Date: Apr. 19, 2017

(87) PCT Pub. No.: WO2016/063977
PCT Pub. Date: Apr. 28, 2016

(65) Prior Publication Data

US 2017/0307160 A1 Oct. 26, 2017

(30) Foreign Application Priority Data

Oct. 24, 2014 (JP) ..... 2014-217261

(51) Int. Cl.
*F21S 11/00* (2006.01)
*E06B 9/24* (2006.01)
(Continued)

(52) U.S. Cl.
CPC ..... *F21S 11/002* (2013.01); *E06B 9/24* (2013.01); *F21S 19/005* (2013.01);
(Continued)

(58) Field of Classification Search
CPC ..... F21S 11/002; F21S 11/007
See application file for complete search history.

(56) References Cited

U.S. PATENT DOCUMENTS 4,673,609 A * 6/1987 Hill ..... B32B 17/10247 219/203
2014/0160570 A1* 6/2014 Jaster ..... F21S 11/00 359/597
(Continued)

FOREIGN PATENT DOCUMENTS

JP 2010-138659 6/2010
JP 2011-117161 6/2011
(Continued)

OTHER PUBLICATIONS

International Search Report for PCT/JP2015/079984, dated Dec. 15, 2015, 3 pages.
(Continued)

*Primary Examiner* — Christopher E Mahoney
(74) *Attorney, Agent, or Firm* — Nixon & Vanderhye P.C.

(57) ABSTRACT

A daylighting apparatus of the present invention includes: a daylighting sheet (13) that has first and second surfaces opposite to each other and that lets light in through the first surface and lets the light out through the second surface at a predetermined distribution of angles; and a visible light-reflecting sheet (15) that reflects part of visible light falling on the first surface of the daylighting sheet (13).

18 Claims, 21 Drawing Sheets

(51) Int. Cl.
*F21S 19/00* (2006.01)
*E06B 3/67* (2006.01)
*F21V 23/04* (2006.01)

(52) U.S. Cl.
CPC ..... *E06B 3/6715* (2013.01); *E06B 2009/2405* (2013.01); *E06B 2009/2417* (2013.01); *F21V 23/0464* (2013.01)

(56) References Cited

U.S. PATENT DOCUMENTS

| | | | | |
|---|---|---|---|---|
| 2015/0309228 | A1* | 10/2015 | Vasiliev | G02B 27/1006 136/257 |
| 2016/0076718 | A1* | 3/2016 | Gardiner | F21S 11/007 359/596 |
| 2017/0114972 | A1* | 4/2017 | Padiyath | G02B 5/0242 |
| 2017/0146208 | A1* | 5/2017 | Ueki | E06B 9/24 |

FOREIGN PATENT DOCUMENTS

| | | |
|---|---|---|
| JP | 2013-156554 | 8/2013 |
| JP | 2014-163209 | 9/2014 |

OTHER PUBLICATIONS

Written Opinion of the ISA for PCT/JP2015/079984, dated Dec. 15, 2015, 5 pages.

* cited by examiner

DAYLIGHTING APPARATUS

This application is the U.S. national phase of International Application No. PCT/JP2015/079984 filed Oct. 23, 2015, which designated the U.S. and claims priority to Japanese Patent Application No. JP 2014-217261 filed Oct. 24, 2014, the entire contents of each of which are hereby incorporated by reference.

TECHNICAL FIELD

The present invention relates to a daylighting apparatus.

The present disclosure contains subject matter related to that disclosed in Japanese Priority Patent Application JP 2014-217261 filed in the Japan Patent Office on Oct. 24, 2014, the entire contents of which are hereby incorporated by reference.

BACKGROUND ART

PTL 1 proposes a daylighting panel for letting sunlight into a room through a window or the like of a building. This daylighting panel includes: a panel; a substrate layer formed on one surface of the panel; a plurality of unit prisms having trapezoidal cross-sections; and a protective layer covering the plurality of unit prisms.

Sunlight is let into the room by passing through the substrate layer, the unit prisms, and the protective layer in sequence.

CITATION LIST

Patent Literature

PTL 1: Japanese Unexamined Patent Application Publication No. 2013-156554

SUMMARY OF INVENTION

Technical Problem

The daylighting apparatus can be an exterior component to the eyes of a person who looks at the building from the outside, as the daylighting apparatus is installed by the window. For example, a building that appears bright as a whole has an advantage of conveying a higher sense of luxuriousness. However, while the daylighting apparatus, which has high daylighting performance, efficiently introduces outside light into the room and therefore imparts brightness to the inside of the room, the daylighting apparatus has the action of making the place of its installation appear dark when the building is looked at from the outside. This causes the building to lose the sense of luxuriousness, causes the apparatus to be less expressive in appearance, causes a person who looks at the building from the outside to feel a sense of incongruity because of disharmony with other bright exterior parts, and causes other similar problems.

An aspect of the present invention is a daylighting apparatus that can make the place of its installation appear bright.

Solution to Problem

A daylighting apparatus according to an aspect of the present invention includes: a daylighting member that has first and second surfaces opposite to each other and that lets light in through the first surface and lets the light out through the second surface at a predetermined distribution of angles; and a reflecting member that reflects part of visible light falling on the first surface of the daylighting member.

In the daylighting apparatus according to the aspect of the present invention, the reflecting member may be provided in at least part of a plane facing the first surface of the daylighting member.

In the daylighting apparatus according to the aspect of the present invention, the reflecting member may further have a function of transmitting the visible light.

In the daylighting apparatus according to the aspect of the present invention, the reflecting member may have a reflectance that periodically varies in one in-plane direction.

In the daylighting apparatus according to the aspect of the present invention, the daylighting member may include a first substrate, a plurality of daylighting portions arrayed in one direction on a first surface of the first substrate, and a void part provided between each of the daylighting portions and the other, and there may be a coincidence between the direction in which the reflectance of the reflecting member periodically varies and the direction in which the plurality of daylighting portions are arrayed.

In the daylighting apparatus according to the aspect of the present invention, the reflecting member may include a reflecting portion that reflects the visible light and a transmitting portion that transmits the visible light.

In the daylighting apparatus according to the aspect of the present invention, the reflecting member may include a visible light-transmitting substrate and a plurality of reflecting portions provided all over the visible light-transmitting substrate.

In the daylighting apparatus according to the aspect of the present invention, the plurality of reflecting portions may be constituted by reflective ink printed all over the visible light-transmitting substrate.

In a daylighting apparatus according to an aspect of the present invention, the reflecting member may include a visible light-reflecting substrate and a plurality of transmitting portions provided in the visible light-reflecting substrate.

In the daylighting apparatus according to the aspect of the present invention, the plurality of transmitting portions may be constituted by a plurality of through-holes provided in the visible light-reflecting substrate.

In the daylighting apparatus according to the aspect of the present invention, the reflecting member may be constituted by a semi-transmissive member that reflects part of the visible light and transmits part of the visible light.

In the daylighting apparatus according to the aspect of the present invention, the reflecting member may be provided in contact with the first surface of the daylighting member.

The daylighting apparatus according to the aspect of the present invention may further include a frame that houses the daylighting member and the reflecting member.

The daylighting apparatus according to the aspect of the present invention may further include a light-diffusing member, provided toward the second surface of the daylighting member, which diffuses the light having exited through the second surface.

Advantageous Effects of Invention

An aspect of the present invention makes it possible to achieve a daylighting apparatus that can make the place of its installation appear bright.

DESCRIPTION OF EMBODIMENTS

First Embodiment

A first embodiment of the present invention is described below with reference to FIGS. 1 to 9.

A daylighting apparatus of the present embodiment is one that is installed, for example, on a part of a window of an office building to let sunlight into a room.

Figure 1:
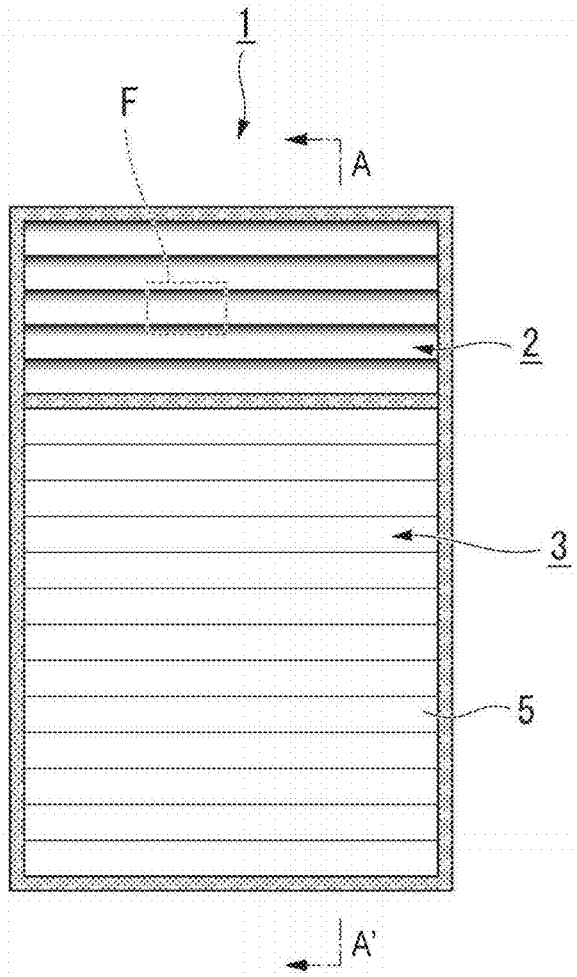
FIG. 1 is a front view showing the appearance of a window with a daylighting apparatus of a first embodiment installed thereon.
Figure 2:
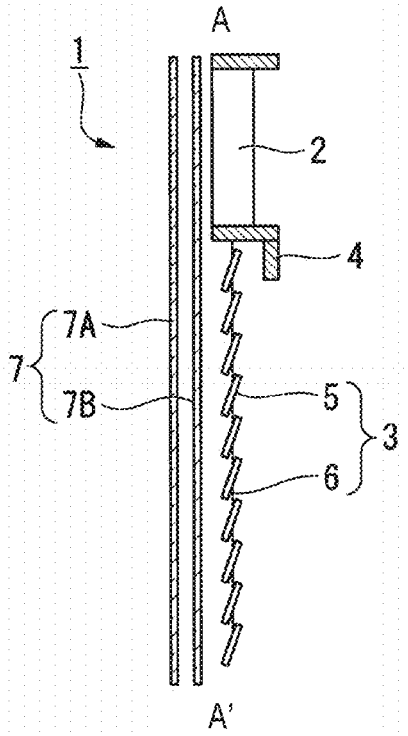
FIG. 2 is a cross-sectional view taken along line A-A' in FIG. 1.

FIG. 1 is a front view showing the appearance of a window with a daylighting apparatus of the first embodiment installed thereon. FIG. 2 is a cross-sectional view taken along line A-A' in FIG. 1.

It should be noted that, to facilitate visualization of each constituent element, each of the following drawings may illustrate some constituent elements on different dimension scales.

As shown in FIGS. 1 and 2, a daylighting apparatus 2 is installed on an upper part of a window 1, and a blind 3 is installed on a lower part of the window 1. Assuming that the window 1 has a height of, for example, 270 cm from the floor to the ceiling in a standard office, the daylighting apparatus 2 is installed in a range of approximately 70 cm from the ceiling, and the blind 3 is installed in a range of approximately 200 cm below the daylighting apparatus 2. An upper part of the blind 3 is housed in a blind box 4. The blind 3 includes a plurality of slats 5 and a ladder chord 6 joining the plurality of slats 5 to one another. Each of the slats 5 has a width of, for example, approximately 25 mm. In this example, the window 1 is constituted by double-glazed glass 7 (two pieces of glass 7A and 7B). The daylighting apparatus 2, the blind 3, and the window 1 are rectangular in shape when viewed from the front. FIG. 2 omits to illustrate a configuration of the daylighting apparatus 2 in detail.

Figure 3:
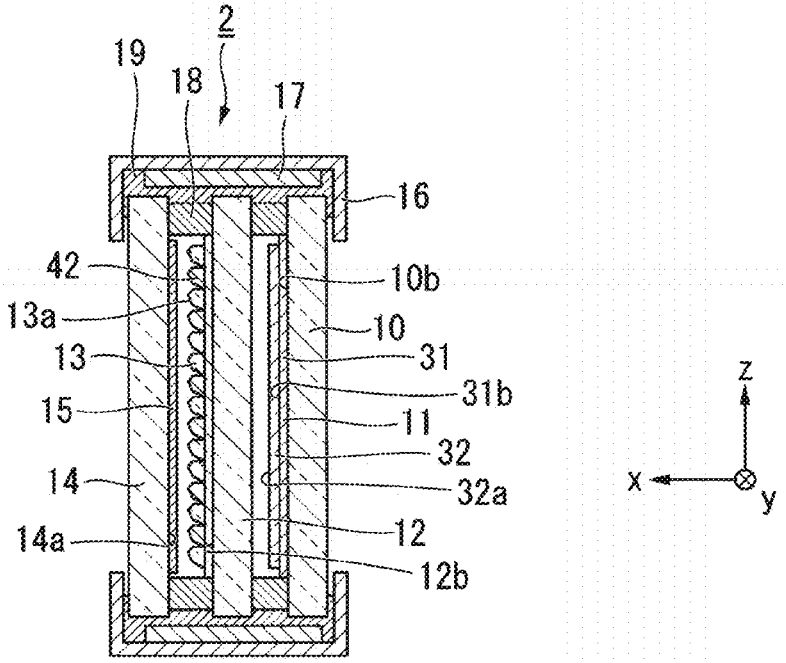
FIG. 3 is a cross-sectional view of the daylighting apparatus.

FIG. 3 is a cross-sectional view of the daylighting apparatus 2.

As shown in FIG. 3, the daylighting apparatus 2 of the present embodiment includes a daylighting sheet 13 and a visible light-reflecting sheet 15. The daylighting sheet 13 has first and second surfaces opposite to each other. The daylighting sheet 13 lets in light through the first surface and lets the light out through the second surface at a predetermined distribution of angles. The visible light-reflecting sheet 15 reflects part of visible light falling on the first surface 13*a* of the daylighting sheet 13. Specifically, the daylighting apparatus 2 of the present embodiment includes a first glass plate 10, a light-diffusing sheet 11, a second glass plate 12, the daylighting sheet 13, a third glass plate 14, the visible light-reflecting sheet 15, a frame 16, a cushioning material 17, an adhesive material 18, and a caulking material 19.

The plurality of glass plates and the sheets are placed so that the first glass plate 10, the light-diffusing sheet 11, the second glass plate 12, the daylighting sheet 13, the visible light-reflecting sheet 15, and the third glass plates 14 are arranged in this order from the inside of the room toward the outside of the building. The visible light-reflecting sheet 15 is provided in at least part of a plane facing the first surface 13*a* of the daylighting sheet 13. That is, of the sheets, the visible light-reflecting sheet 15 is placed closest to the outside of the building. This allows an observer who is outside of the window to see the visible light-reflecting sheet 15 by receiving reflected light from the visible light-reflecting sheet 15.

The daylighting sheet 13 of the present embodiment corresponds to the daylighting member of the claims. The visible light-reflecting sheet 15 of the present embodiment corresponds to the reflecting member of the claims. The light-diffusing sheet 11 of the present embodiment corresponds to the light-diffusing member of the claims.

For convenience of explanation, an indoor-side surface of each of the glass plates is hereinafter referred to as "first surface", and an outdoor-side surface of each of the glass plates is hereinafter referred to as "second surface".

The light-diffusing sheet 11 is bonded to a second surface 10*b* of the first glass plate 10. The daylighting sheet 13 is bonded to a second surface 12*b* of the second glass plate 12. The visible light-reflecting sheet 15 is bonded to a first surface 14*a* of the third glass plate 14. The first, second, and third glass plates 10, 12, and 14 are glass plates, approximately 3 to 6 mm in thickness, bonded to each other using the adhesive material 18 with spaces therebetween.

The frame 16, which is made of a material such as aluminum or resin, covers the edges of a laminate formed by stacking the three glass plates 10, 12, and 14. Therefore, the frame 16 houses the three glass plates 10, 12, and 14 with the aforementioned sheets respectively bonded thereto. The cushioning material 17, which is made, for example, of rubber, is provided between end faces of the laminate and the frame 16. Furthermore, the caulking material 19, which is for example a silicone caulking material, fills the space between the edges of the laminate and the frame 16.

Figure 4:
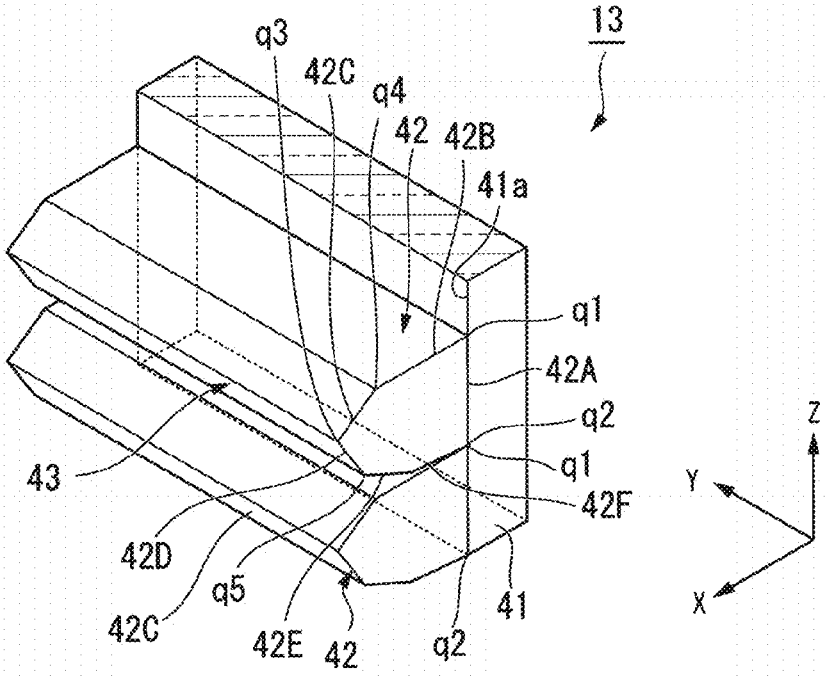
FIG. 4 is a perspective view of a daylighting sheet.

FIG. 4 is a perspective view of the daylighting sheet 13.

As shown in FIG. 4, the daylighting sheet 13 is a sheet that has a microstructure formed on a surface thereof on the order of several tens to several hundreds of micrometers so as to introduce outside light, i.e. sunlight, into the room. The daylighting sheet 13 includes a film substrate 41, a plurality of daylighting portions 42, and a void part 43 provided between each of the daylighting portions 42 and the other. The plurality of daylighting portions 42 are provided in stripes on a second surface 41*a* of the film substrate 41. The daylighting portions 42 extend in a Y direction (horizontal direction) and are arranged parallel to one another in a Z direction (vertical direction).

As the film substrate 41, an optical transparent substrate containing a resin such as a thermoplastic polymer, a thermosetting resin, or a photopolymerizable resin is used. An optically transparent substrate of an acrylic polymer, an olefinic polymer, a vinyl polymer, a cellulose polymer, an amide polymer, a fluorinated polymer, a urethane polymer, a silicone polymer, an imide polymer, or the like is used. Specifically, an optically transparent substrate such as a triacetyl cellulose (TAC) film, a polyethylene terephthalate (PET) film, a cycloolefin polymer (COP) film, a polycarbonate (PC) film, a polyethylene naphthalate (PEN) film, a polyether sulfone (PES) film, or a polyimide (PI) film is preferably used. In the present embodiment, as an example, a PET film having a thickness of 100 μm is used. It is preferable that the film substrate 41 have a total light transmittance of, for example, 90% or higher.

This gives sufficient transparency.

The daylighting portions 42 are made of an optically transparent and photosensitive organic material such as acrylic resin, epoxy resin, or silicone resin. A transparent resin mixture obtained by mixing a polymerization initiator, a coupling agent, a monomer, an organic solvent, and the like into this resin is used. Furthermore, the polymerization initiator may contain various types of additional component such as a stabilizer, an inhibitor, a plasticizer, a fluorescent brightening agent, a mold release agent, a chain transfer agent, and another photopolymerizable monomer. In the present embodiment, the daylighting portions 42 are made, for example, of polymethylmethacrylate (PMMA). It is preferable that the daylighting portions 42 have a total light transmittance of 90% or higher under JIS K7361-1. This gives sufficient transparency.

In the present embodiment, the plurality of daylighting portions 42 are formed on the film substrate 41 by a thermal imprinting method. The daylighting portions 42 may be formed by a method other than the thermal imprinting method, such as a UV imprinting method, a thermal pressing method, an injection molding method, an extrusion molding method, or a compression molding method. In a method such as a melt extrusion method or a mold extrusion method, the film substrate 41 and the daylighting portions 42 are integrally formed by the same resin. Alternatively, a shape-transferring (UV transfer/thermal transfer) resin applied onto a base film of PET or the like may be molded into a structure by imprinting.

The refractive index of each of the daylighting portions 42 takes on a value of approximately 1.5. The present embodiment encompasses the range of approximately 1.35, which is a refractive index in the case of mixture of fluorinated additives into the chief material, to 1.6, which is a refractive index in the case of mixture of a conjugated composition of allyl groups or the like into the chief material, and each of the daylighting portions 42 has a refractive index falling within the range.

Each of the daylighting portions 42 stretches out long and thin in a linear fashion in one direction (i.e. the Y direction of FIG. 4) and has a polygonal cross-sectional shape when cut along a plane orthogonal to a longitudinal direction. Specifically, the cross-sectional shape of each of the daylighting portions 42 is a hexagon with six vertices (q1 to q6) whose interior angles are all less than 180 degrees. The plurality of daylighting portions 42 are arrayed in the vertical direction so that a longitudinal direction of each of the daylighting portions 42 is parallel to sides of the rectangular film substrate 41 that extend in the horizontal direction.

The first and second vertices q1 and q2 of the hexagonal cross-sectional shape of each of the daylighting portions 42 correspond to both ends of a first side 42A of the daylighting portion 42 that touches the film substrate 41. The fourth, fifth, and sixth vertices q4, q5, and q6 are not located on the first side 42A. The third vertex q3 is farthest away from the first surface 42A. The length of a perpendicular line through the third vertex q3 to the first side 42A is greater than the length of a perpendicular line through any of the vertices q1 to q6 other than the third vertex q3 to the first side 42A. The shape of each of the daylighting portions 42 is asymmetrical with respect to the perpendicular line through the third vertex q3 to the first side 42A.

It should be noted that the shape of each of the daylighting portions 42 is not limited to the aforementioned shape but may be polygonal, trapezoidal, or triangular in cross-section orthogonal to the longitudinal direction.

As shown in FIG. 3, the daylighting sheet 13 is provided on the second surface 12*b* of the second glass plate 12 so that the longitudinal direction of each of the daylighting portions 42 faces horizontally and the array direction of the plurality of daylighting portions 42 faces in the vertical direction (Z direction). The daylighting sheet 13 is bonded to the second glass plate 12 in a state where the surface on which the microstructure formed by the plurality of daylighting portions 42 is provided faces the outside of the room (i.e. faces the third glass plate 14).

In a state where the daylighting apparatus 2 has been installed on the window 1, the daylighting sheet 13 is installed in such a posture that second and third surfaces 42B and 42C of the hexagonal cross-sectional shape of each of the daylighting portions 42 face upward in the vertical direction and fourth, fifth, and sixth surfaces 42D, 42E, and 42F of the hexagonal cross-sectional shape of each of the daylighting portions 42 face downward in the vertical direction.

It is desirable that the film substrate 41 and the daylighting portions 42 be substantially equal in refractive index to each other. A reason for this is as follows: For example, in a case where the film substrate 41 and the daylighting portions 42 are greatly different in refractive index from each other, light having entered the film substrate 41 from the daylighting portions 42 may unnecessarily become refracted or reflected at the interface between the daylighting portions 42 and the film substrate 41, and in this case, there may occur problems such as the failure to achieve the desired daylighting properties and a decrease in luminance.

Air is present in the void part 43. Therefore, the void part 43 has a refractive index of approximately 1.0. The refractive index of 1.0 of the void part 43 minimizes a critical angle at an interface (air interface) 42*c* between the void part 43 and a daylighting portion 42.

The light-diffusing sheet 11 is anisotropic in direction of diffusion of light and has the property of diffusing light more strongly in the horizontal direction (Y direction) than in the vertical direction (Z direction). As shown in FIG. 3, the light-diffusing sheet 11 has a lenticular lens structure including a substrate 31 and a plurality of convex lens components 32 provided on a second surface 31*b* of the substrate 31. The light-diffusing sheet 11 is bonded to the second surface 10*b* (i.e. a surface that faces the second glass plate 12) of the first glass plate 10 in such a posture that the convex lens components 32 face the second glass plate 12. The plurality of convex lens components 32 extend in the vertical direction (Z direction) and are arrayed parallel to one another in the horizontal direction (Y direction).

Each of the convex lens components 32 has a convex surface 32*a* that has a curvature in a horizontal plane but does not have a curvature in a vertical plane. Therefore, the convex lens components 32 have high light diffusion properties in the horizontal direction (Y direction) but do not have light diffusion properties in the vertical direction (Z direction). This causes light having entered the light-diffusing sheet 11 to exit from the convex lens components 32 while being greatly diffused in the horizontal direction (Y direction) but almost without being diffused in the vertical direction (Z direction). It should be noted that FIG. 3 is a cross-sectional view taken along the vertical plane and therefore does not show the curved shapes of the convex surfaces 32*a*.

The convex lens components 32 may be ones integrated with the substrate 31 by processing the second surface 31*b* of the substrate 31 per se or may be ones that are separate from the substrate 31. The light-diffusing sheet 11 does not need to have a regular structure such as a lenticular lens structure but may include a plurality of irregularly-provided projections. Alternatively, the light-diffusing sheet 11 may be one that includes an optically transparent resin layer that serves as a medium and a plurality of fibrous or elliptical light-diffusing particles dispersed in the optically transparent resin layer so that the light-diffusing particles align themselves in the horizontal direction.

In the present embodiment, the light-diffusing sheet 11 used has the anisotropy to diffuse light more strongly in the horizontal direction (Y direction) than in the vertical direction (Z direction). This makes it possible to reduce glare and, at the same time, achieve an average brightness regardless of the azimuth of the sun. However, in some cases, a light-diffusing sheet may be used which has the anisotropy to diffuse light more strongly in the vertical direction (Z direction). This makes it possible to reduce nonuniformity in brightness in a depth direction of the room. Alternatively, a light-diffusing sheet may be used which diffuses light isotropically.

Figure 5:
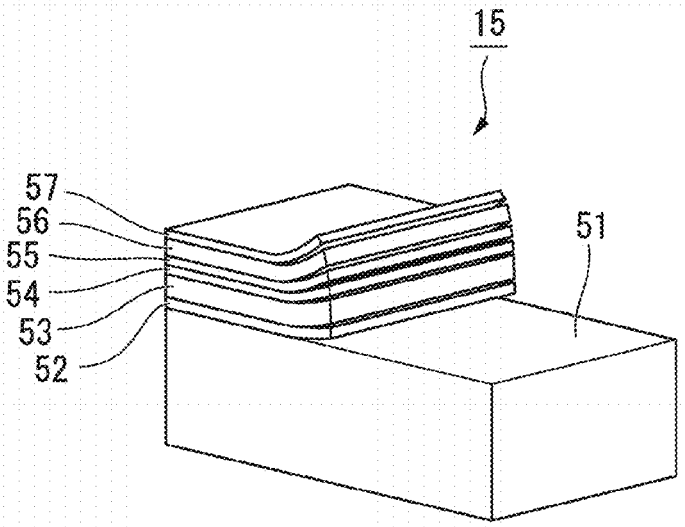
FIG. 5 is a perspective view of a visible light-reflecting sheet.

FIG. 5 is a perspective view of the visible light-reflecting sheet.

The visible light-reflecting sheet includes a reflecting portion that reflects visible light and a transmitting portion that transmits visible light. This allows the visible light-reflecting sheet to a function of reflecting part of visible light coming from the outside and transmitting part of the visible light.

As shown in FIG. 5, the visible light-reflecting sheet 15 has a laminate structure including a visible light-transmitting substrate 51, an adhesive material layer 52, a resin film 53, a visible light-reflecting layer 54 including a plurality of patterns, an adhesive material layer 55, a resin film 56, and a hard coating layer 57. The substrate 51 is constituted, for example, by a film of polyethylene terephthalate (PET).

The resin films 53 and 56 are constituted, for example, by resin films of polyester or the like. The adhesive material layers 52 and 55 are made of an optically transparent adhesive material having ultraviolet absorptivity. The hard coating layer 57 is provided to impart abrasion resistance to the laminate located therebelow and has high hardness and transparency.

The visible light-reflecting layer 54 of the present embodiment corresponds to the reflecting portions of the claims.

The plurality of patterns of the visible light-reflecting layer 54 are printed on the resin film 53. Although not shown in FIG. 5, the visible light-reflecting layer 54 is not solidly formed on the resin film 53 but patterned into predetermined shapes as will be described later. The visible light-reflecting layer 54 is constituted by UV curable ink that instantaneously cures, for example, upon irradiation with ultraviolet radiation (UV light). The visible light-reflecting layer 54 has a thickness of, for example, approximately several tens of micrometers. The use of the UV curable ink makes it possible to print the desired patterns on the resin film 53 of polyester or the like. The visible light-reflecting layer 54 is formed by white ink and has high reflectance.

Note, however, that the visible light-reflecting layer 54 does not necessarily need to be white but may for example be beige or light gray to match the color of the exterior of the building or the color of the blind. That is, the visible light-reflecting layer 54 is constituted by reflective ink printed all over the substrate 51.

Figure 6:
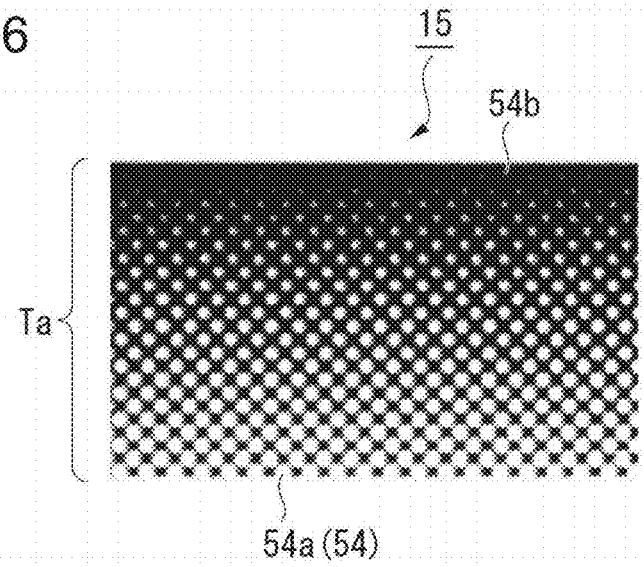
FIG. 6 is an enlarged view of a part denoted by sign F in FIG. 1.

FIG. 6 is a plan view of the third glass plate 14 as viewed from the front (in the direction of the normal), with the visible light-reflecting sheet 15 bonded thereto. FIG. 6 is an enlarged view of a part denoted by sign F in FIG. 1. This part is a unit region of the visible light-reflecting sheet 15 that is 20 mm in dimensions in the vertical direction.

As shown in FIG. 6, the visible light-reflecting layer 54 of the visible light-reflecting sheet 15 has patterns 54*a* provided as a plurality of circular patterns all over the substrate 51. The part 54*a* indicated by white in FIG. 6 is a region in which the visible light-reflecting layer 54 has a pattern 54*a*. The part 54*b* indicated by black is a region in which the visible light-reflecting layer 54 has no pattern 54*a*. Therefore, the part 54*b* indicated by black in FIG. 6 is a part in which the substrate 51 is exposed and a region that appears transparent in actuality. Each of the patterns 54*a* serves as a reflection region, and the region other than the patterns 54*a* serves as a transmission region. However, these regions are not meant to be a region with a reflectance of 100% or a region with a transmittance of 100% but meant to be a mostly reflection region or a mostly transmission region, although both reflection and transmission may occur in both of these regions.

The patterns 54*a* range, for example, from approximately 15 μm to 1.5 mm in diameter and so sized that an observer several meters away cannot recognize each separate pattern.

In general, visual acuity is expressed as the reciprocal of a visual angle expressed in units of 1 minute, which is one sixtieth of 1 degree. Specifically, the angle formed by the gap of a Landolt ring used for testing vision and the center of an eye is the visual angle, and the reciprocal of the visual angle is the visual acuity. A "visual acuity of 1.0" is defined in Japan as the ability to, when viewing, from 5 m away, a Landolt ring made by making a gap 1.5 mm in width in a part of a circle 7.5 mm in diameter and 1.5 mm in thickness, accurately decide on which direction the gap faces in. Judging from these discussions on Landolt rings, an observer 5 m away with ordinary visual acuity cannot recognize each separate pattern 54*a*, provided the pattern is 1.5 mm or smaller. The plurality of patterns 54*a* as a whole are recognized by an observer as a pattern of light and dark corresponding to the density of the patterns 54*a*. On the other hand, the lower limit of 15 μm is determined by the capacity of a printing apparatus. Currently, a common printing apparatus has a printing capacity of approximately several tens of micrometers.

The plurality of circular patterns 54*a* of the visible light-reflecting layer 54 are regularly arranged in each unit region Ta. Those of the patterns 54*a* which are in a lower part of the unit region Ta are larger, and those of the patterns 54*a* which are in an upper part of the unit region Ta are smaller. Therefore, the percentage of areas occupied by patterns 54*a* per unit area becomes higher toward the lower part of the unit region Ta and becomes lower toward the upper part of the unit region Ta. The visible light-reflecting layer 54 reflects light having fallen on the patterns 54*a* (i.e. the white parts of FIG. 6) thereof and transmits light having fallen on a part (i.e. the black part of FIG. 6) thereof other than the patterns 54*a*.

In other words, the light reflectance becomes higher toward the lower part of the unit region Ta and becomes lower toward the upper part of the unit region Ta. The visible light-reflecting sheet 15 as a whole has a configuration of repetition of unit regions Ta having such an arrangement of patterns. For this reason, the reflectance of the visible light-reflecting sheet 15 periodically varies in one in-plane direction.

A method for manufacturing a daylighting apparatus 2 configured as described above is described below with reference to FIGS. 7(*a*) to 7(*c*).

In manufacturing a daylighting apparatus, a first glass plate 10 with a light-diffusing sheet 11 bonded thereto, a second glass plate 12 with a daylighting sheet 13 bonded thereto, and a third glass plate 14 with a visible light-reflecting sheet 15 bonded thereto are prepared. Illustration of these sheets is omitted. These sheets may be bonded to the respective glass plates 10, 12, 14, for example, by dry bonding using an acrylic adhesive material or by water bonding using a water-bonding adhesive material with fine adjustments of the bonding positions.

Figure 7:
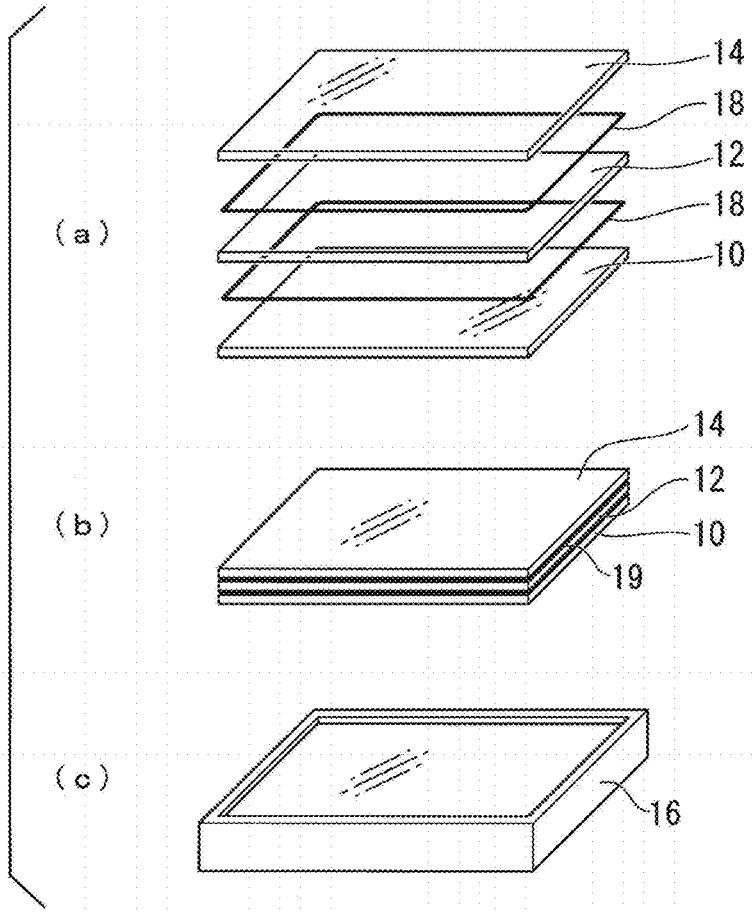
FIG. 7 illustrates step-by-step perspective views (A) to (C) showing a method for manufacturing a daylighting apparatus.

Next, as shown in FIG. 7(*a*), the glass plates 10, 12, and 14 with the three sheets bonded thereto are bonded to each other with spaces therebetween. Assume here that the front and back of each of the glass plates 10, 12, and 14 face as shown in FIG. 3. A rubber-like adhesive material 18 formed in the shapes of frames is interposed between the first and second glass plates 10 and 12 and between the second and third glass plates 12 and 14. The adhesive material 18 sticks the glass plates together and also serves as spacers that keep the spaces between the glass plates.

Next, as shown in FIG. 7(*b*), a caulking material 19 is so supplied to the edges of the three glass plates 10, 12, and 14 bonded to each other that the three glass plates 10, 12, and 14 do not easily delaminate.

Next, as shown in FIG. 7(*c*), a frame 16 is attached to the edges of the three glass plates 10, 12, and 14 thus integrated. At this point in time, a cushioning material 17 (not illustrated) is inserted between the three glass plates 10, 12, and 14 and the frame 16 in order to avoid contact between the three glass plates 10, 12, and 14 and the frame 16 and to cushion the impact of application of external force to the frame 16.

The action of the daylighting apparatus 2 of the present embodiment is described with reference to FIG. 8.

Figure 8:
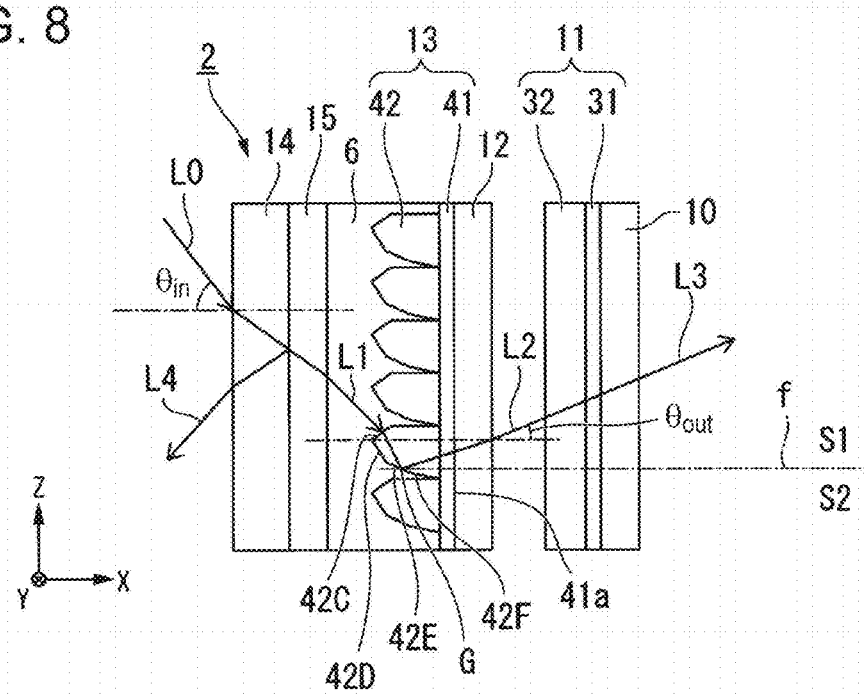
FIG. 8 is a diagram for explaining the action of the daylighting apparatus.

For convenience of explanation, let it be assumed that the point of incidence G is a point at which a given beam of light having entered a daylighting portion 42 shown in FIG. 8 falls on the fifth surface 42E (reflecting surface) of the daylighting portion 42. Let it be also assumed that the straight line f is an imaginary straight line orthogonal to the first surface 41*a* of the film substrate 41 that passes through the point of incidence G. Let it be also assumed that, of two spaces bordered by a horizontal plane including the straight line f, the first space S1 is a space that is on the side of presence of light L1 arriving at the point of incidence G and the second space S2 is a space that is on the side of absence of the light L1 arriving at the point of incidence.

As shown in FIG. 8, light L0 having entered the daylighting apparatus 2 from obliquely above at an angle of incidence of $\theta in \geq 0$ degree is refracted by the third glass plate 14 and enters the visible light-reflecting sheet 15. Of the light L having entered the visible light-reflecting sheet 15, light having fallen on the patterns 54*a* (reflecting portions) of the visible light-reflecting layer 54 is reflected, and light having fallen on the part (transmitting portion) other than the patterns 54*a* is transmitted. Light L1 having passed through the visible light-reflecting sheet 54 enters the daylighting sheet 13 from obliquely above. The light L1 having entered the daylighting portion 42 is reflected upon entering through the third surface 42C, travels toward the fifth surface 42E, is reflected by the fifth surface 42E, and then exits through the second glass plate 12 toward the first space S1 at an angle of emergence of $\theta out \geq 0$ degree. Light L2 having exited through the second glass plate 12 enters the light-diffusing sheet 11 and is diffused by the convex lens components 32 in the horizontal direction. Although light L3 diffused by the light-diffusing sheet 11 is indicated by an arrow in FIG. 8 and therefore appears not to be diffused, the light L3 is actually diffused by the action of the convex lens components 32 in a direction perpendicular to the surface of paper.

The light L3 diffused by the light-diffusing sheet 11 turns into light that travels toward the ceiling and illuminates a wide range in the depth direction of the room. Therefore, the daylighting apparatus 2 allows outside light (sunlight) let in to be efficiently guided toward the ceiling of the room. This makes it possible to make the room bright without causing a person who is in the room to feel dazzled.

It should be noted that the aforementioned optical path is a mere example and outside light having entered the daylighting apparatus 2 falls on either of the second and third surfaces 42B and 42C of each of the daylighting portions 42 of the daylighting sheet 13. This light exits through the first surface 42A after being reflected by any of the fourth, fifth, and sixth surfaces 42D, 42E, and 42F. Thus, there are several optical paths of light passing through the daylighting portions 42.

As shown in FIG. 8, light reflected by the visible light-reflecting sheet 15 travels obliquely downward and enters the eyes of an observer who is outside of the window. At some point distant from the window, the observer cannot recognize each separate pattern 54*a* (see FIG. 6) of the visible light-reflecting layer 54 but recognizes variations in density of the patterns 54*a* (see FIG. 6) as a gradation of light and dark. For that reason, as shown in FIG. 1, the observer recognizes horizontal stripes approximately 20 mm in width when looking at the daylighting apparatus 2 from outside of the window 1. Meanwhile, the blind 3, which is installed below the daylighting apparatus 2, includes the slats 5, 25 mm in width, and an ordinary blind is configured such that upper and lower sluts slightly overlap each other in a closed state. This causes the observer to see the horizontal stripes, approximately 20 mm in width, when looking at the blind 3 from outside of the window 1.

Thus, there is a coincidence between the direction in which the reflectance of the visible light-reflecting sheet 15 periodically varies and the direction in which the plurality of slats 5 are arrayed. This causes the observer to see horizontal stripes of substantially the same width both in the place of installation of the daylighting apparatus 2 and the place of installation of the blind 3 when looking at the window 1 from outside of the building. Thus, the daylighting apparatus 2 of the present embodiment can achieve such an appearance as to give a sense of unity with the blind located therebelow.

The inventors of the present invention actually fabricated a daylighting apparatus of the present embodiment, installed it on a window, and checked the appearance of it.

Figure 9:
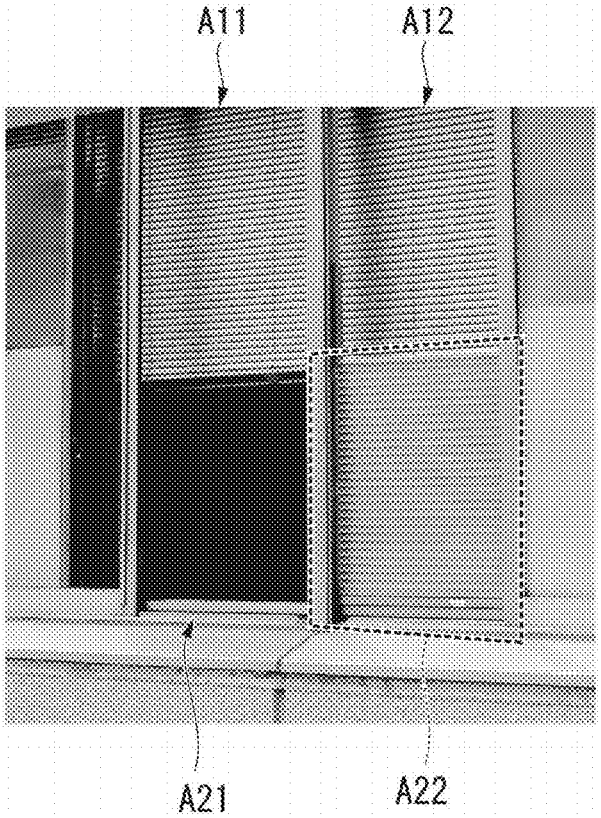
FIG. 9 is a photograph for showing the effect of the daylighting apparatus.

FIG. 9 shows a photograph taken of the window from outside of the building. It should be noted that, in this experiment, contrary to the arrangement of the present embodiment, blinds were installed on an upper part of the window and the daylighting apparatus was installed below the blinds.

In FIG. 9, signs A11 and A12 denote regions in which the blinds were installed, sign A21 denotes a region in which no daylighting apparatus was installed, and sign A22 denotes a region in which the daylighting apparatus was installed.

In the region A21, where no daylighting apparatus was installed, light was let into the room through the window, and very little light was reflected toward the outside; therefore, this part appeared much darker in appearance than the regions A11 and A12, in which the blinds were installed. On the other hand, in the region A22, where the daylighting apparatus of the present embodiment was installed, the action of the visible light-reflecting sheet gave a high-reflectance pattern of horizontal stripes; as a result, this part was similar in appearance to the regions A11 and A12, in which the blinds were installed. It was therefore confirmed that a sense of unity was given as if the whole window had been provided with a uniform blind.

In the present embodiment, although the visible light-reflecting sheet 15 is formed by high-reflectance white ink, the color of the ink is not limited to white. For example, the color of the ink may be high-brightness light gray or pale blue or green, which matches the color of the interior or exterior. Note, however, that it is desirable that the visible light-reflecting sheet 15 have a reflectance of a certain value or higher, e.g. a visible light reflectance (Y value) of 60% or higher. A reason for this is that a sense of unity with the exterior can be given by the visible light-reflecting sheet 15 reflecting outside light and exhibiting a reflectance which is equal to that of the exterior such as the outside walls of the building. It should be noted that, instead of including the visible light-reflecting layer, the visible light-reflecting sheet may include a metal thin-film pattern formed by vapor evaporation or by sputtering and etching or may include a metal thin-film pattern formed by mask vapor deposition.

In the present embodiment, since the portions of the visible light-reflecting layer 54 that serve as the patterns 54*a* hardly transmit light into the room, there is a decrease in daylighting performance according to the area covered by the visible light-reflecting layer 54.

Therefore, the area of the region in which the patterns 54*a* are formed cannot be made larger than is necessary. It is desirable that the area of a pattern-forming region of the visible light-reflecting layer 54 be approximately 5 to 50% of the whole area of the visible light-reflecting layer 54. The area of the pattern-forming region needs only be appropriately determined according to which of various parameters has priority. The various parameters include the orientation of the window, the location of the building, the transmittance of the window outside of the daylighting apparatus, the reflectance of the exterior, fastidiousness with exterior design, and the like.

Second Embodiment

A second embodiment of the present invention is described below with reference to FIG. 10.

A daylighting apparatus of the present embodiment is identical in basic configuration to that of the first embodiment but differs from that of the first embodiment in terms of the placement of the visible light-reflecting sheet.

Figure 10:
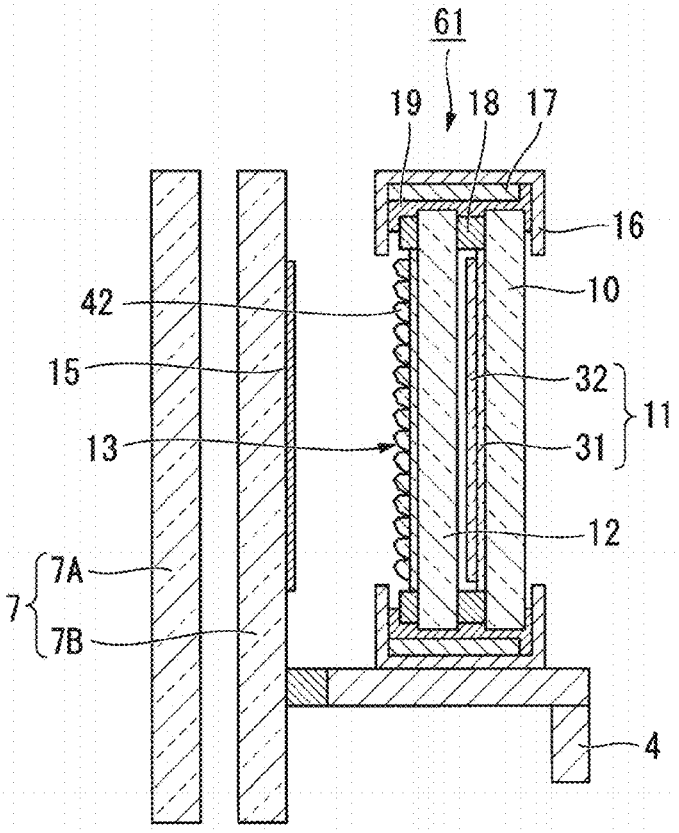
FIG. 10 is a cross-sectional view of a window with a daylighting apparatus of a second embodiment installed thereon.

FIG. 10 is a cross-sectional view of a window with the daylighting apparatus of the second embodiment installed thereon.

Constituent elements shown in FIG. 10 that are common to the drawings referred to in the first embodiment are given the same reference signs and, as such, are not described in detail.

In the first embodiment, the daylighting apparatus includes the third glass plate, and the visible light-reflecting sheet is bonded to the third glass plate. On the other hand, as shown in FIG. 10, a daylighting apparatus 61 of the second embodiment includes no third glass plate, and the visible light-reflecting sheet 15 is bonded to the indoor-side surface of the indoor-side piece of glass 7A of the double-glazed glass 7 constituting the window. In terms of the other components, the second embodiment is identical to the first embodiment.

As with the first embodiment, the present embodiment brings about an effect of making it possible to achieve a daylighting apparatus that gives a sense of unity to the appearance of a window with a blind installed thereon. Furthermore, the present embodiment needs only two glass plates to constitute the daylighting apparatus 61, thus making it possible to achieve reductions in weight, thickness, and cost of daylighting apparatuses.

Third Embodiment

A third embodiment of the present invention is described below with reference to FIG. 11.

A daylighting apparatus of the present embodiment is identical in basic configuration to that of the first embodiment but differs from that of the first embodiment in terms of the configuration of a visible light-reflecting portion.

Figure 11:
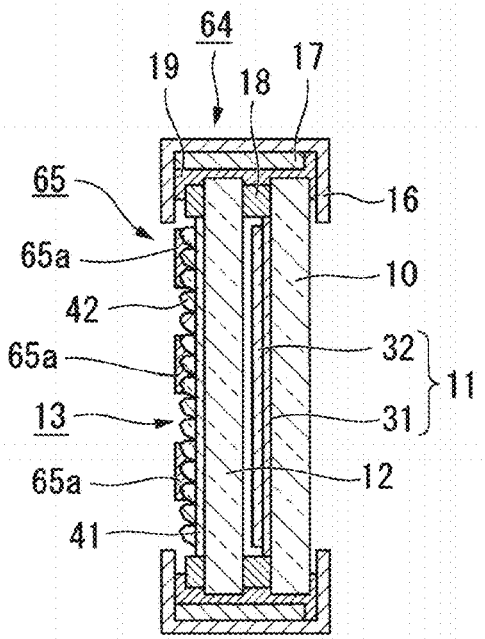
FIG. 11 is a cross-sectional view of a daylighting apparatus of a third embodiment.

FIG. 11 is a cross-sectional view of a daylighting apparatus of the third embodiment.

Constituent elements shown in FIG. 11 that are common to the drawings referred to in the first embodiment are given the same reference signs and, as such, are not described in detail.

In the first embodiment, the daylighting apparatus includes the third glass plate, and the visible light-reflecting sheet is bonded to the third glass plate. On the other hand, as shown in FIG. 11, a daylighting apparatus 64 of the third embodiment includes no third glass plate, and patterns 65*a* of a visible light-reflecting layer 65 are printed directly on the daylighting sheet 13. The patterns 65*a* are provided so as to cover the plurality of daylighting portions 42. Although FIG. 11 shows an example in which the patterns 65*a* are printed on a surface of the daylighting sheet 13 on which the daylighting portions 42 are provided, the patterns 65*a* may alternatively be provided on a surface of the film substrate 41 on which no daylighting portions 42 are provided. In terms of the other components, the third embodiment is identical to the first embodiment.

As with the first and second embodiments, the present embodiment brings about an effect of making it possible to achieve a daylighting apparatus that gives a sense of unity to the appearance of a window with a blind installed thereon. Furthermore, the present embodiment needs only two glass plates to constitute the daylighting apparatus 64, thus making it possible to achieve reductions in weight, thickness, and cost of daylighting apparatuses.

Fourth Embodiment

A fourth embodiment of the present invention is described below with reference to FIG. 12.

A daylighting apparatus of the present embodiment is identical in basic configuration to that of the first embodiment but differs from that of the first embodiment in terms of the configuration of a visible light-reflecting portion.

Figure 12:
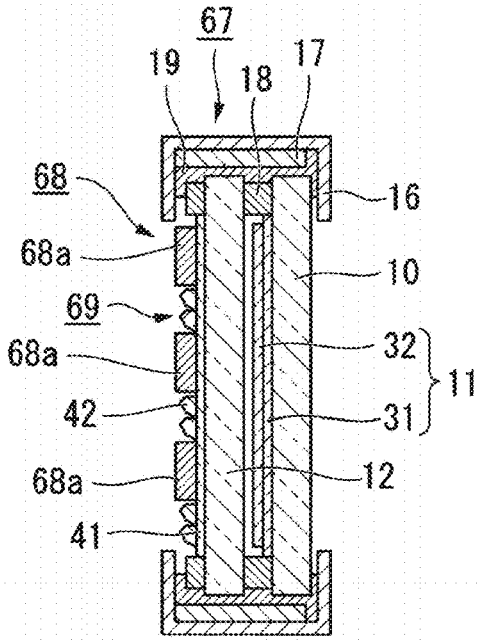
FIG. 12 is a cross-sectional view of a daylighting apparatus of a fourth embodiment.

FIG. 12 is a cross-sectional view of a daylighting apparatus of the fourth embodiment.

Constituent elements shown in FIG. 12 that are common to the drawings referred to in the first embodiment are given the same reference signs and, as such, are not described in detail.

In the third embodiment, the patterns of the visible light-reflecting layer are provided so as to cover the plurality of daylighting portions. On the other hand, as shown in FIG. 12, a daylighting apparatus 67 of the fourth embodiment is configured such that a region in which no daylighting portions 42 are formed is provided in a part of a daylighting sheet 69 and patterns 68*a* of a visible light-reflecting layer 68 are printed in the region where no daylighting portions 42 are formed. That is, the daylighting portions 42 and the visible light-reflecting layer 68 are separately fabricated on the daylighting sheet 69. Although FIG. 12 shows an example in which the patterns 68*a* are printed on a surface of the daylighting sheet 69 on which the daylighting portions 42 are provided, the patterns 68*a* may alternatively be provided on the surface of the film substrate 41 on which no daylighting portions 42 are provided. In terms of the other components, the fourth embodiment is identical to the first embodiment.

As with the first to third embodiments, the present embodiment brings about an effect of making it possible to achieve a daylighting apparatus that gives a sense of unity to the appearance of a window with a blind installed thereon. Furthermore, the present embodiment needs only two glass plates to constitute the daylighting apparatus 67, thus making it possible to achieve reductions in weight, thickness, and cost of daylighting apparatuses.

Example 1

The inventors of the present invention actually fabricated a daylighting apparatus including a visible light-reflecting sheet and evaluated the optical properties of the daylighting apparatus. The following shows the results of the evaluation.

Figure 13:
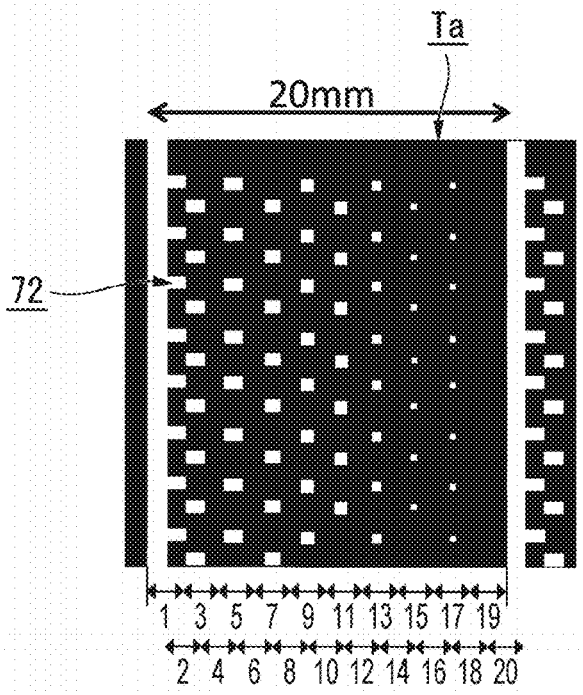
FIG. 13 is a plan view of a visible light-reflecting sheet of Example 1.

The inventors of the present invention fabricated a visible light-reflecting sheet having printed patterns 72 such as those shown in FIG. 13. In FIG. 13, as in FIG. 6, regions in which the printed patterns 72 are present are indicated by white, and a region in which no printed patterns 72 are present is indicated by black. A plurality of unit regions Ta were repeatedly formed. Each of the unit regions TA was 20 mm in width. Each of the unit regions Ta had a gradual change in density of the plurality of printed patterns 72. In this example, the shape of each separate printed pattern 72 was quadrangular.

Figure 14:
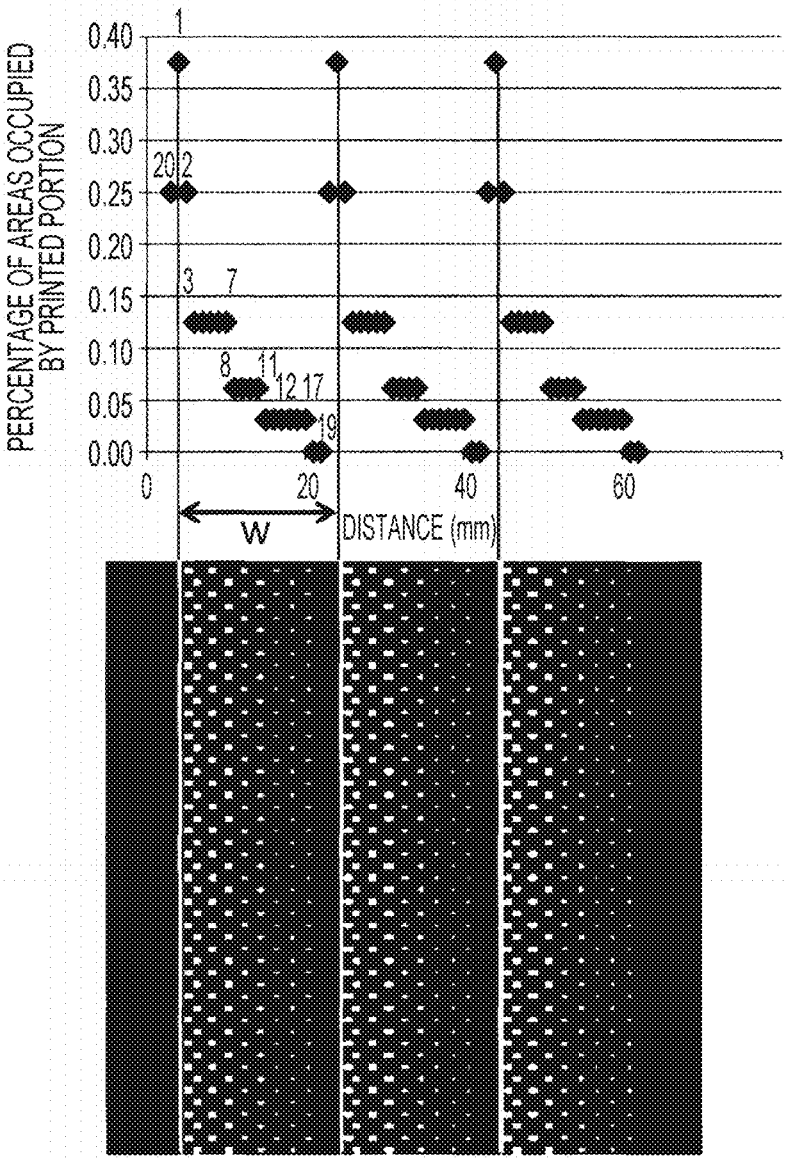
FIG. 14 is a diagram showing the percentage of areas occupied by a printed portion in different places in the visible light-reflecting sheet.

Let it be assumed here that a 20-mm-wide unit region Ta is divided into twenty smaller 2-mm-wide reed-shaped regions staggered 1 mm apart in the direction of increase and decrease in density of the printed patterns 72. These twenty smaller regions were numbered 1, 2, 3, . . . , and 20, respectively, in descending order of gross area of printed patterns 72 (from the left to the right in FIG. 13). The percentages of areas occupied by printed patterns 72 at the design phase were calculated for each separate one of the twenty smaller regions and plotted on a graph shown in FIG. 14. In FIG. 14, the horizontal axis represents the distance (mm) from a reference point, and the vertical axis represents the percentage of areas occupied by printed patterns. After this plotting, the sizes of the printed patterns 72 in each of the smaller regions were adjusted so that a person who looks at the sheet feels an appropriate sense of change in brightness.

It was found that carrying out the design of drawing a substantially smooth curve in the width W of 20 mm in the graph of FIG. 14 results in the formation of a smooth gradation from a bright region to a dark region in the appearance of the visible light-reflecting sheet. The printed patterns may be dot patterns such as those shown in FIG. 13 or line patterns. Note, however, that the eyes of a human has such a characteristics as to average brightness by juxtaposition color mixture when looking at fine patterns. For that reason, the printed patterns give a gradation with a smoother sense of change when they are dot patterns than when they are line patterns. In the present example, the printed patterns were designed on the basis of this idea, and the visible light-reflecting sheet was fabricated so that the average percentage of areas occupied by printed patterns was 9.6%.

Example 2

The inventors of the present invention fabricated four types of visible light-reflecting sheet under different specifications and evaluated the optical properties of the visible light-reflecting sheets.

The visible light-reflecting sheet of Example 1 has white printed patterns formed by a gravure printing method, and the percentages of areas occupied by the printed patterns in the whole visible light-reflecting sheet is 50.0%.

The visible light-reflecting sheet of Example 2 has white printed patterns formed by a UV inkjet method, and the percentages of areas occupied by the printed patterns in the whole visible light-reflecting sheet is approximately 16%.

The visible light-reflecting sheet of Example 3 has printed patterns formed by mixed ink of white (W) and cyan (C) by the UV inkjet method, and the percentages of areas occupied by the printed patterns in the whole visible light-reflecting sheet is approximately 13%.

The visible light-reflecting sheet of Example 4 has printed patterns formed by mixed ink of white (W) and magenta (M) by the UV inkjet method, and the percentages of areas occupied by the printed patterns in the whole visible light-reflecting sheet is approximately 10%.

Items of evaluation of a single printed portion having printed patterns formed thereon include total light transmittance, total light reflectance, absorptance, and rectilinear transmittance. The results of evaluation of these items are shown in [Table 1].

TABLE 1

| Items | Example 1 | Example 2 | Example 3 | Example 4 |
|---|---|---|---|---|
| Printing Method | Gravure Printing | | UV Inkjet | |
| Printed Color | White | W100 | W100 + C10 | W100 + M10 |
| Total Light Transmittance Tt (Y Value) | 42.9% | 32.2% | 24.9% | 21.0% |
| Total Light Reflectance Tr (Y Value) | 57.1% | 65.4% | 56.4% | 51.9% |
| Absorptance Ta (Y Value) | 0.0% | 2.5% | 18.7% | 27.1% |
| Rectilinear Transmittance | 1.8% | 0.05% | 0.04% | 0.03% |
| Reflection (L*/a*/b*) | 80.2/−1.7/2.7 | 84.7/−3.2/−9.6 | 80.1/−10.5/−7.4 | 77.2/4.0/−6.7 |

It should be noted that, in the column "Printed Color" of Table 1, W100 represents printing in solid white (with a grayscale of 100%). W100+C10 represents printing in solid white with cyan added thereto with a grayscale of 10%. In this case, the printed patterns exhibit slightly-cyanic white. Similarly, W100+M10 represents printing in solid white with magenta added thereto with a grayscale of 10%.

In this case, the printed patterns exhibit slightly-magenta white.

Figure 15:
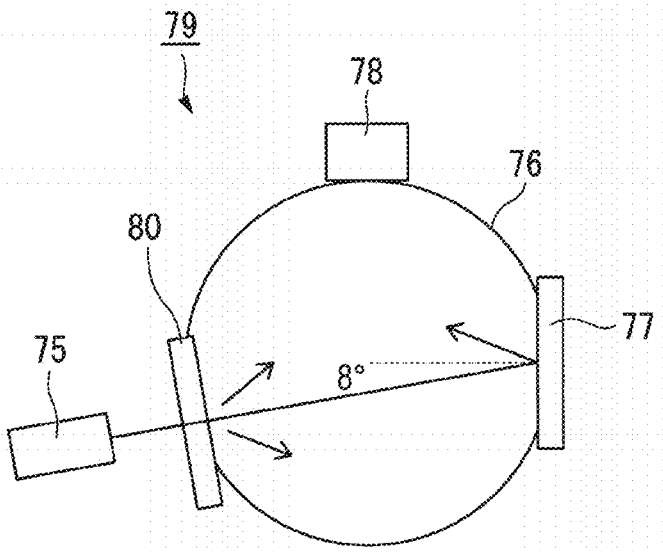
FIG. 15 is a diagram showing a method for measuring the total light transmittance of a visible light-reflecting sheet.

As shown in FIG. 15, the total light transmittance Tt was measured by a measuring device 79 including a light source 75, an integrating sphere 76, a white plate 77, a spectrophotometer 78 (JASCO Corporation's V-670). The measuring device 79 was used such that light emitted from the light source 75 and then transmitted through a visible light-reflecting sheet 80, which was a measuring object, was allowed to fall on the white plate 77 at a predetermined angle (e.g. at an angle of incidence of 8 degrees) and reflected light from the white plate 77 was detected by the spectrophotometer 78.

Figure 16:
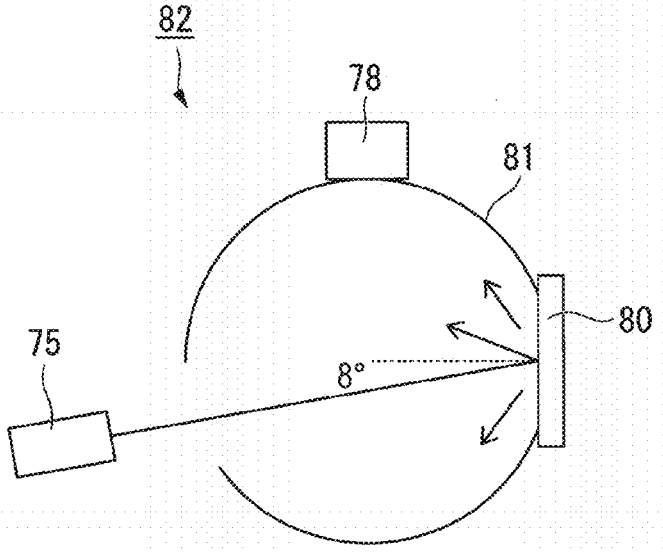
FIG. 16 is a diagram showing a method for measuring the total light reflectance of a visible light-reflecting sheet.

As shown in FIG. 16, the total light reflectance Tr was measured by a measuring device 82 including a light source 75, an integrating sphere 81, and a spectrophotometer 78. The measuring device 82 was used such that light emitted from the light source 75 was allowed to fall on the visible light-reflecting sheet 80, which was the measuring object, at a predetermined angle (e.g. at an angle of incidence of 8 degrees) and reflected light from the visible light-reflecting sheet 80 was detected by the spectrophotometer 78.

The absorptance Ta was calculated using the total light transmittance Tt and the total light reflectance Tr according to equation (1):

$$Ta=1-(Tt+Tr) \quad (1)$$

Figure 18:
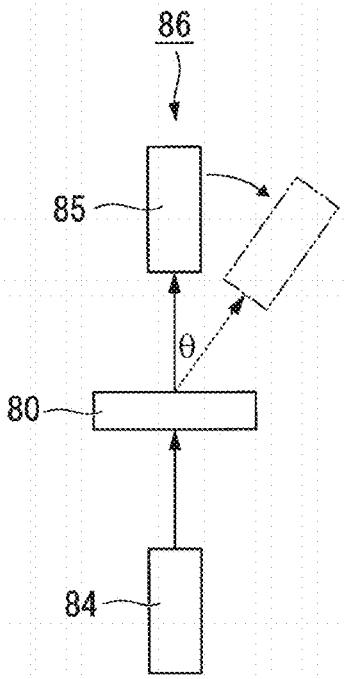
FIG. 18 is a diagram showing a method for measuring the intensity of transmitted light in FIG. 17.

As shown in FIG. 18, the rectilinear transmittance was measured by an angular luminance meter 86 (Otsuka Electronics Co., Ltd.'s LCD-5200) including a light emitter 84 and a light receiver 85. Note here that the visible light-reflecting sheet 80, which was the measuring object, was a sheet whose whole surface had been subjected to printing. The light emitter 84 was fixed so that light was perpendicularly incident on the visible light-reflecting sheet 80. The light receiver 85 was configured to be able to change its position so as to be able to receive reflected light whose angle θ falls within the range of 0 degree to 70 degrees with respect to the normal to the visible light-reflecting sheet 80. The rectilinear transmittance is a transmittance as measured when the angle θ is 0 degree.

The visible light-reflecting sheet 80 includes a printed portion and a non-printed portion (transparent portion). Therefore, the performance of the visible light-reflecting sheet 80 is determined by the optical properties of the printed portion, the optical properties of the transparent portion, and the percentages of areas occupied by the printed portion and the transparent portion. [Table 1] above shows the optical properties of the printed portion, which function as a reflecting layer. In a case where a visible light-reflecting sheet is used, consideration should be given to the "daylighting component", the "scatter component", and the "reflection component", which will be described later, and these components serve as indices of daylighting performance, non-design element, and appearance reflectance, respectively. The results of measurement of the total light transmittance Tt, total light reflectance Tr, rectilinear transmittance, reflected colors L*a*b* of each of the examples as the optical properties of the sheet in association with these indices are tabulated in [Table 1].

As a visible light-reflecting sheet having such properties, a transparent film with printed patterns formed thereon was used. The printed patterns took the form of a striped gradation of white patterns. Each of the horizontal stripes was 20 mm in width. The printed patterns were formed by the gravure printing method or the UV inkjet method. The color in which the patterns were printed was a mixture of white and cyan (C) or a mixture of white and magenta (M), as well as white. This makes it possible to give a sense of unity as a tint with the exterior of the building and to impart design. For example, as in Examples 3 and 4, the yellowish tint of the UV cut layer of the daylighting apparatus or the greenish tint of the double-glazed glass can be cancelled out by printing white with slight coloring added thereto. As a result, the printed white can appear more whitish when viewed from outside of the window.

Next, items of evaluation of the whole visible light-reflecting sheet integrating a printed portion and a non-printed portion (transparent portion) include the aforementioned daylighting component, scatter component, and reflection component.

The results of evaluation of these items are shown in [Table 2].

TABLE 2

| Items | | Example 1 | Example 2 | Example 3 | Example 4 |
|---|---|---|---|---|---|
| Printing Method | | Gravure Printing | UV Inkjet | | |
| Printed Portion | Color | White | W100 | W100 + C10 | W100 + M10 |
| | Percentage of Areas Occupied | 50% | 16% | 13% | 10% |
| Whole | Daylighting Component | 46% | 73% | 76% | 79% |
| | Scatter Component | 21% | 5% | 3% | 2% |
| | Reflection Component | 29% | 11% | 7% | 5% |

The daylighting component was calculated according to equation (2):

$$\text{Daylighting Component} = \text{Rectilinear Transmittance of Printed Portion} \times \text{Percentage of Areas Occupied by Printed Portion} + \text{Rectilinear Transmittance of Transparent Portion} \times \text{Percentage of Areas Occupied by Transparent Portion} \quad (2)$$

The daylighting component serves as an index of the daylighting performance of a daylighting sheet with a visible light-reflecting sheet stacked thereon. The closer the value of the daylighting component is to 100%, the more the daylighting sheet can exert its original daylighting performance.

The scatter component was calculated according to equation (3):

$$\text{Scatter Component} = \text{Total Light Transmittance of Printed Portion} \times \text{Percentage of Areas Occupied by Printed Portion} \quad (3)$$

The scatter component serves as an index of a so-called non-design component, i.e. a component that, in the case of a daylighting sheet with a visible light-reflecting sheet stacked thereon, is not taken into consideration when outside light falls on the visible light-reflecting sheet alone. The smaller the value of the scatter component is, the more the daylighting sheet can exert its daylighting performance as designed.

The reflection component was calculated according to equation (4):

$$\text{Reflection Component} = \text{Total Light Reflectance of Printed Portion} \times \text{Percentage of Areas Occupied by Printed Portion} \quad (4)$$

The reflection component serves as an index of the appearance reflectance of a daylighting sheet with a visible light-reflecting sheet stacked thereon. The larger the value of the reflection component is, the brighter the appearance is and the easier it is to give a sense of unity with the exterior of the building.

For each of the visible light-reflecting sheets of Examples 1 to 4, a tabulation of details of the performance of the printed portion, the performance of the non-printed portion (transmitting portion), and the performance of the sheet as a whole is shown in [Table 3].

TABLE 3

| | | Example 1 Gravure Printing | Example 2 UV Inkjet | Example 3 UV Inkjet | Example 4 UV Inkjet |
|---|---|---|---|---|---|
| Printed Portion | Color | White | W100 | W100 + C10 | W100 + M10 |
| | Total Light Transmittance (Y Value) | 42.9% | 32.2% | 24.9% | 21.0% |
| | Rectilinear Transmittance | 1.84% | 0.05% | 0.04% | 0.03% |
| | Total Light Reflectance (Y Value) | 57.1% | 65.4% | 56.4% | 51.9% |
| | Absorptance | 0.1% | 2.5% | 18.7% | 27.1% |
| | Percentage of Areas Occupied | 50.0% | 16.2% | 12.9% | 9.6% |
| Transparent Portion | Total Light Transmittance (Y Value) | 90.7% | 87.0% | 87.0% | 87.0% |
| | Rectilinear Transmittance | 90.7% | 87.0% | 87.0% | 87.0% |
| | Total Light Reflectance (Y Value) | 9.3% | 13.0% | 13.0% | 13.0% |
| | Absorptance | 0.0% | 0.0% | 0.0% | 0.0% |
| | Percentage of Areas Occupied | 50.0% | 83.8% | 87.1% | 90.4% |
| Whole | Total Light Transmittance | 66.8% | 78.5% | 79.1% | 81.3% |
| | Total Light Reflectance | 33.2% | 21.5% | 18.0% | 16.7% |

TABLE 3-continued

| | Example 1 Gravure Printing | Example 2 UV Inkjet | Example 3 UV Inkjet | Example 4 UV Inkjet |
|---|---|---|---|---|
| Absorptance | 0.0% | 0.0% | 2.9% | 2.0% |
| Daylighting Component | 46.3% | 73.5% | 76.4% | 79.3% |
| Scatter Component | 21.0% | 5.2% | 2.7% | 2.0% |
| Colored Portion Reflection Component | 28.6% | 10.6% | 6.7% | 5.0% |

Further, the inventors of the present invention measured the intensity of light scattered and transmitted through the visible light-reflecting sheets of Examples 2 to 4, with variations in the angle θ of the light receiver 85 of the angular luminance meter 86 shown in FIG. 18 from 0 degree to ±70 degrees with respect to the visible light-reflecting sheets of Examples 2 to 4. The results of measurement are shown in a graph of FIG. 17.

Figure 17:
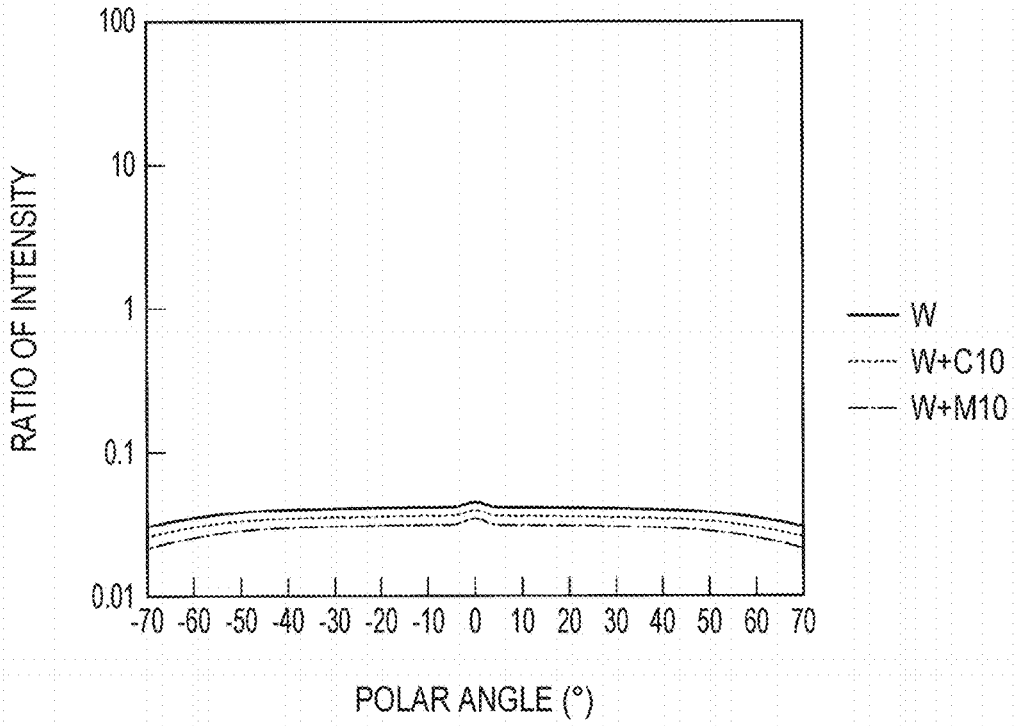
FIG. 17 is a graph showing a relationship between the polar angle and the ratio of intensity of transmitted light in the visible light-reflecting sheet.

In FIG. 17, the horizontal axis represents the angle (polar angle; expressed in degrees), and the vertical axis represents the ratio of intensity (no unit of quantity required) expressed as if it is part of a value of measurement in air which is 100.

As mentioned above, light scattered and transmitted through a visible light-reflecting sheet turns into a non-design element for the daylighting apparatus. Further, unlike light that travels toward a ceiling, such light may undesirably turn into light (glare light) that causes a person who is in the room to feel dazzled. For that reason, it is desirable that the printed portion be low in diffuse transmittance. In that respect, the diffuse transmission properties of the printed portions of the visible light-reflecting sheets of Examples 2 to 4 were as shown in FIG. 17. That is, in any of the examples, the component of rectilinear transmission at an angle of 0 degree has a ratio of intensity of approximately 0.04%, so light is hardly transmitted. In addition, the ratio of intensity is kept low even with increase in angle. It was therefore verified that the printed portion was sufficiently low in diffuse transmittance regardless of angle.

Fifth Embodiment

A fifth embodiment of the present invention is described below with reference to FIGS. 19 to 25.

A daylighting apparatus of the present embodiment is identical in basic configuration to that of the first embodiment but differs from that of the first embodiment in terms of the configuration of a visible light-reflecting sheet.

Figure 19:
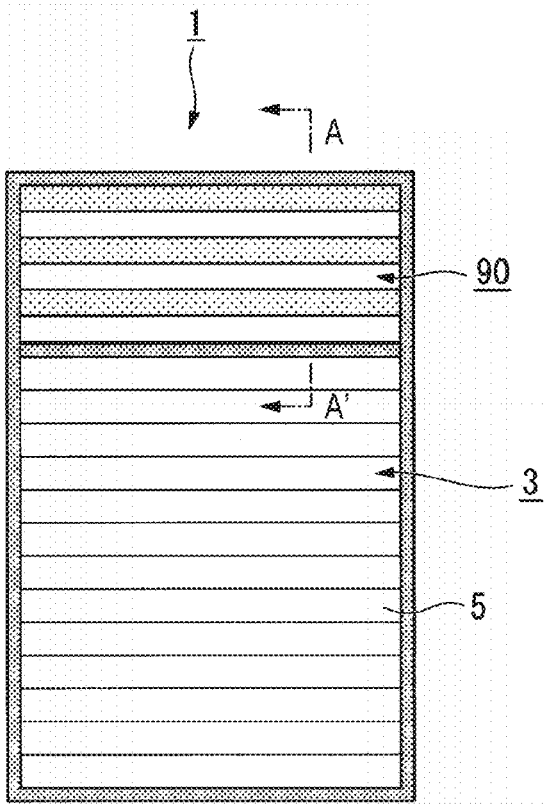
FIG. 19 is a front view showing the appearance of a window with a daylighting apparatus of a fifth embodiment installed thereon.

FIG. 19 is a front view showing the appearance of a window with a daylighting apparatus of the fifth embodiment installed thereon.

Figure 20:
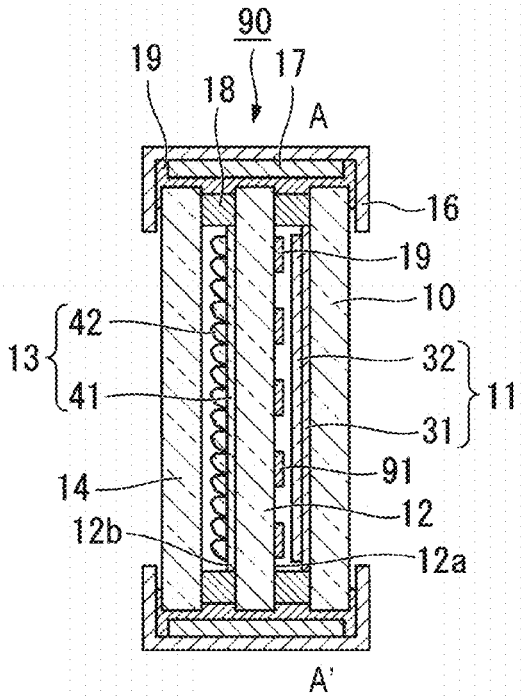
FIG. 20 is a cross-sectional view taken along line A-A' in FIG. 19.

FIG. 20 is a cross-sectional view taken along line A-A' in FIG. 19.

Constituent elements shown in FIGS. 19 to 25 that are common to the drawings referred to in the first embodiment are given the same reference signs and, as such, are not described in detail.

As shown in FIGS. 19 and 20, as in the first embodiment, a daylighting apparatus 90 is installed on the upper part of the window 1, and the blind 3 is installed on the lower part of the window 1. Note, however, that a point of difference lies in that whereas the visible light-reflecting sheet is provided all over the daylighting apparatus in the first embodiment, a plurality of long narrow rectangular visible light-reflecting sheets 91 are provided at spacings from each other in the fifth embodiment. The plurality of visible light-reflecting sheets 91 are bonded to a first surface 12*a* (i.e. a surface that faces the light-diffusing sheet 11) of the second glass plate 12. That is, in the case of the present embodiment, the daylighting sheet 13 is bonded to the second surface 12*b* of the second glass plate 12, and the visible light-reflecting sheets 91 are bonded to the first surface 12*a* of the second glass plate 12.

Figure 21:
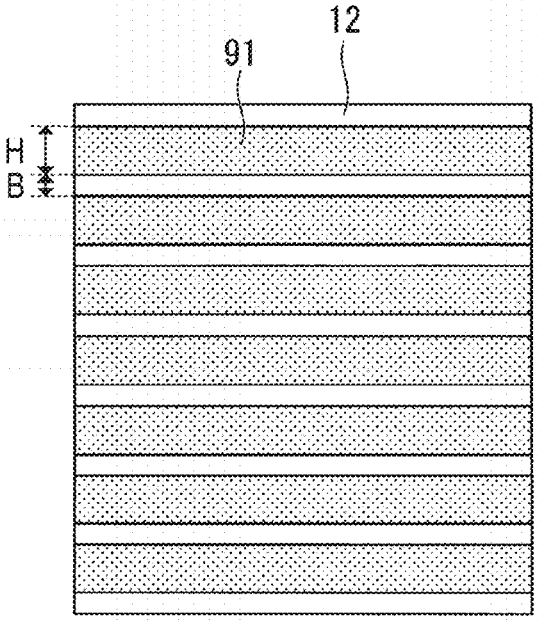
FIG. 21 is a plan view of visible light-reflecting sheets.

FIG. 21 is a plan view of the second glass plate 12 as viewed from the front (in the direction of the normal), with the visible light-reflecting sheets 91 bonded thereto.

As shown in FIG. 21, the visible light-reflecting sheets 91 are bonded to the second glass plate 12 so that a portion to which a visible light-reflecting sheet 91 is bonded and a portion in which the second glass plate 12 is exposed alternate to form regular horizontal stripes. This causes a person who looks at the window from the outside to recognize, as a pattern of horizontal stripes, the difference in reflectance between the portion to which a visible light-reflecting sheet 91 is bonded and the portion to which no visible light-reflecting sheet 91 is bonded. The width H of each visible light-reflecting sheet 91 and the spacing B between adjacent visible light-reflecting sheets 91 are set as appropriate. For example, the width H of each visible light-reflecting sheet 91 is 20 mm, and the spacing B is 10 mm.

Figure 22:
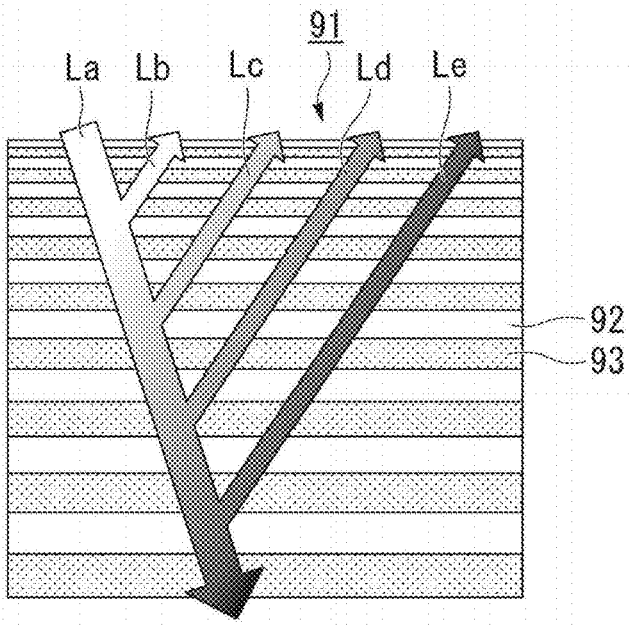
FIG. 22 is a diagram for explaining the action of the visible light-reflecting sheets.

FIG. 22 is a diagram for explaining the configuration and action of the visible light-reflecting sheets 91.

In the first embodiment, the portions of the visible light-reflecting sheet that serve as the printed patterns mainly reflect light, and the portion of the visible light-reflecting sheet other than the printed patterns mainly transmits light. In the fifth embodiment, on the other hand, the visible light-reflecting sheets 91 are uniform in reflection properties and transmission properties of light throughout the whole surface. That is, the visible light-reflection sheets 91 are so-called semitransparent mirror sheets, i.e. semi-transmissive members that reflect and transmit light in definite proportions throughout the whose surface.

Each of the visible light-reflecting sheets 91 is constituted, for example, by a dielectric multilayer or a metal film of aluminum, silver, or the like. FIG. 22 shows an example of a visible light-reflecting sheet 91 constituted by a dielectric multilayer. As shown in FIG. 22, the visible light-reflecting sheet 91 is configured such that a low-refractive-index layer 92 and a high-refractive-index layer 93, for example several hundreds of nanometers in film thickness, are alternately stacked. The low-refractive-index layers 92 and the high-refractive-index layers 93 vary in film thickness every plurality of layers according to where they are stacked.

This allows the visible light-reflecting sheet 91 to function as a so-called selective transmitting/selective reflecting film, i.e. a film that splits the wavelength range (380 to 780 nm)

of visible light La into particular wavelength ranges and emit reflected lights Lb, Lc, Ld, and Le. By thus uniformly transmitting the visible wavelength range of light, requirements for daylighting apparatuses intended to utilize natural light for daytime illumination can be satisfied. Further, part of light is reflected by the whole surface of the visible light-reflecting sheet 91, higher daylighting efficiency can be maintained than in a case where the visible light-reflecting sheet of the first embodiment is used. This makes it possible to provide visible light-reflecting sheets 91 over a wider range in the daylighting apparatus 90.

The reflectance of the daylighting apparatus 90 as a whole can be adjusted by the reflectance of the visible light-reflecting sheets 91 and the area of installation of the visible light-reflecting sheets 91. It is desirable that the reflectance of the daylighting apparatus 90 as a whole range from 30 to 70%. Further, in the case of the present embodiment, where the visible light-reflecting sheets 91 are placed toward the side of the daylighting sheet 13 through which light exits, it is desirable that the visible light-reflecting sheets 91 have the property of preventing diffusion of light having exited from the daylighting sheet 13. In this case, light having entered the visible light-reflecting sheets 91 is reflected, transmitted, or absorbed. This makes it possible to prevent the light from turning into glare light by changing its traveling direction through the visible light-reflecting sheets 91 and entering the room.

Figure 23:
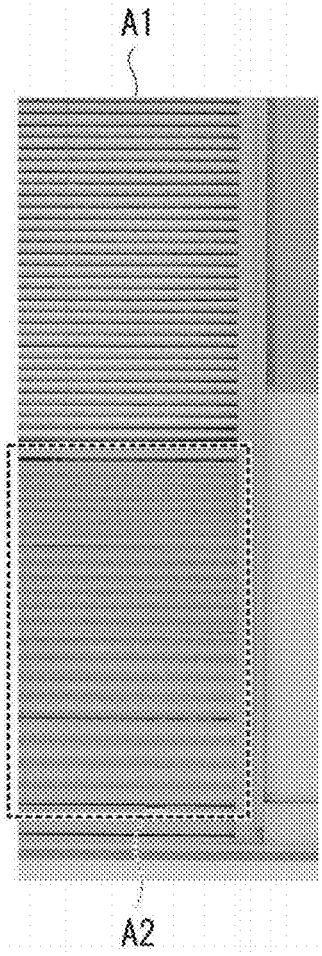
FIG. 23 is a photograph for showing the effect of the daylighting apparatus.

The inventors of the present invention actually fabricated a daylighting apparatus of the fifth embodiment, installed it on a window, and checked the appearance of it. FIG. 23 shows a photograph taken of the window from outside of the building. It should be noted that, in this experiment, contrary to the arrangement of the present embodiment, a blind was installed on an upper part of the window and the daylighting apparatus was installed below the window.

In FIG. 23, sign A1 denotes a region in which the blind was installed, and sign A2 denotes a region in which the daylighting apparatus was installed.

In the region A2, where the daylighting apparatus of the fifth embodiment was installed, the action of the visible light-reflecting sheet gave a high-reflectance pattern of horizontal stripes; as a result, this part was similar in appearance to the region A1, in which the blind was installed. It was therefore confirmed that a sense of unity was given as if the whole window had been provided with a uniform blind.

Example 3

The inventors of the present invention actually fabricated daylighting apparatuses including visible light-reflecting sheets shown in FIG. 21 and evaluated the optical properties of the daylighting apparatuses. The following shows the results of the evaluation.

In this evaluation, the visible light-reflecting sheets had different reflectances R of 70%, 50%, and 20%, and the width H of each visible light-reflecting sheet and the spacing B between adjacent visible light-reflecting sheets were varied as shown in [Table 4].

TABLE 4

| | Example 5 | Example 6 | Example 7 | Example 8 |
|---|---|---|---|---|
| Reflectance R | 70% | 50% | 20% | 20% |
| Width of Reflecting Portion H | 20 mm | 10 mm | 20 mm | — |

TABLE 4-continued

| | Example 5 | Example 6 | Example 7 | Example 8 |
|---|---|---|---|---|
| Spacing between Reflecting Portions B | 20 mm | 10 mm | 5 mm | — |
| Sheet Coverage S | 50% | 50% | 80% | 100% |
| R × S | 35% | 25% | 16% | 20% |

In Example 5, the visible light-reflecting sheets had a reflectance R of 70%. In Example 5, the width H of each visible light-reflecting sheet was 20 mm, and the spacing B between adjacent visible light-reflecting sheets was 20 mm.

In Example 6, the visible light-reflecting sheets had a reflectance R of 50%. In Example 6, the width H of each visible light-reflecting sheet was 10 mm, and the spacing B between adjacent visible light-reflecting sheets was 10 mm.

In Example 7, the visible light-reflecting sheets had a reflectance R of 20%. In Example 7, the width H of each visible light-reflecting sheet was 20 mm, and the spacing B between adjacent visible light-reflecting sheets was 5 mm.

The visible light-reflecting sheet of Example 8 had a reflectance R of 20% and was shaped to cover the whole surface of the second glass plate.

Figure 24:
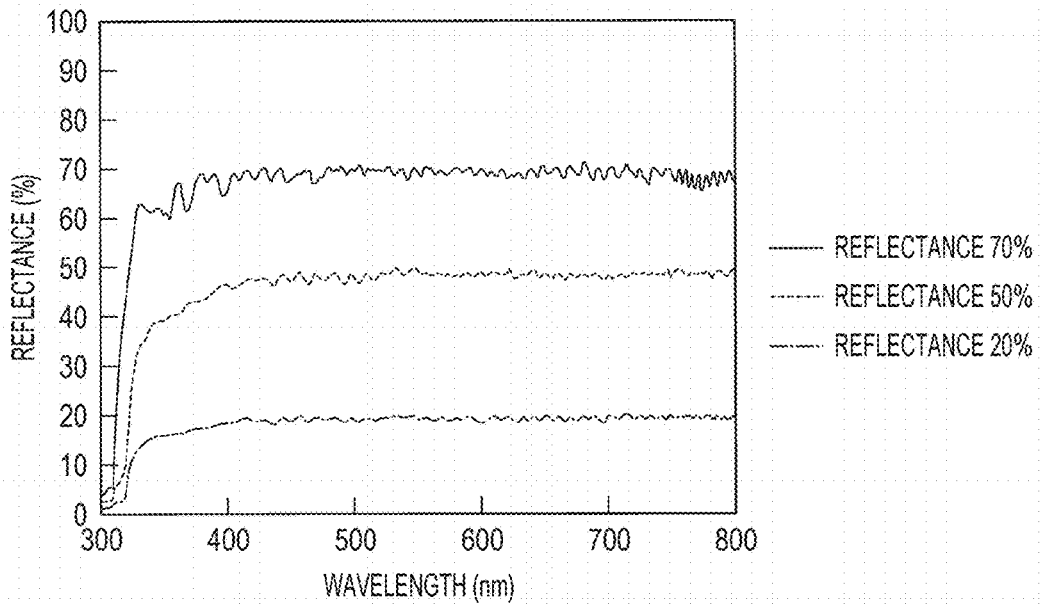
FIG. 24 is a diagram showing the spectral reflectance of the visible light-reflecting sheet.
Figure 25:
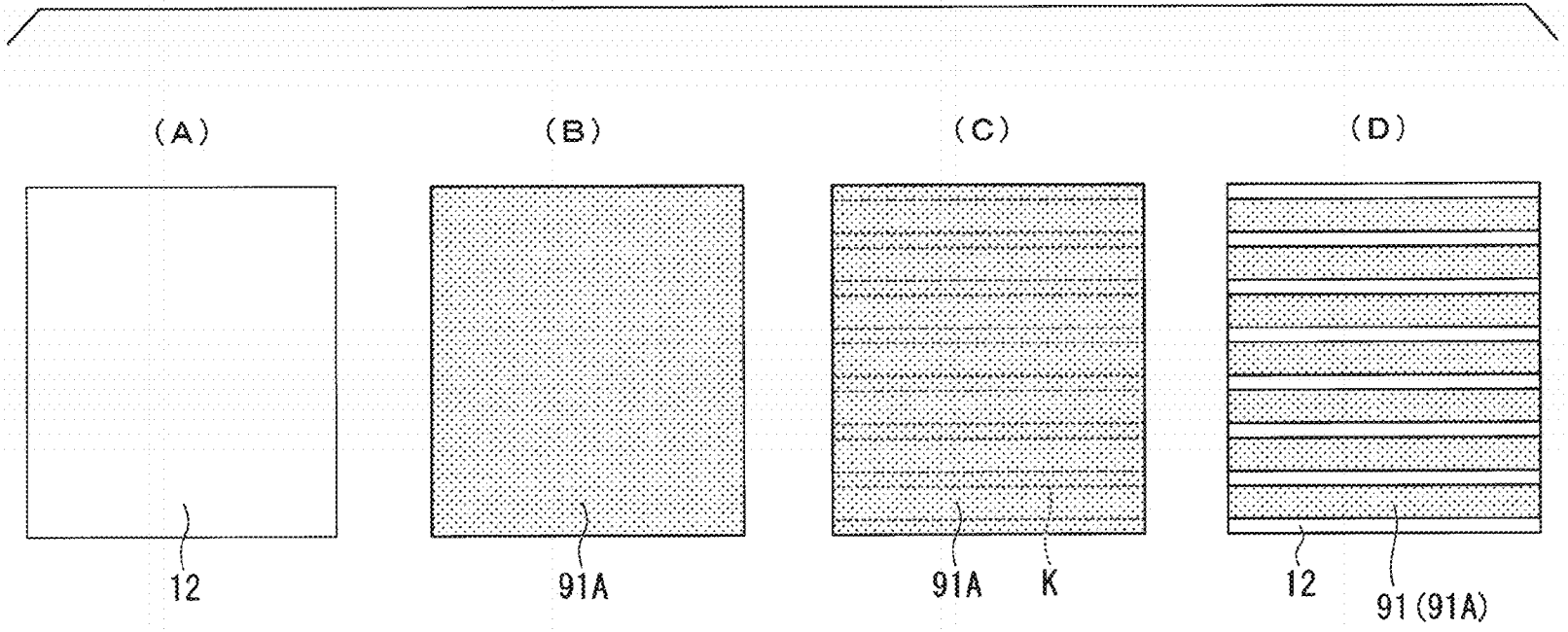
FIG. 25 illustrates step-by-step plan views (A) to (D) showing a method for manufacturing a visible light-reflecting sheet.

The visible light-reflecting sheets with reflectances R of 70%, 50%, and 20% have, for example, spectral reflectance properties shown in FIG. 24. In FIG. 24, the horizontal axis represents the wavelength (nm), and the vertical axis represents the reflectance (%). Each of the visible light-reflecting sheets has a reflectance of approximately 20 to 70% with respect to the visible range of 380 nm to 780 mm. As mentioned earlier, these reflectance properties are properties that are demonstrated by the dielectric multilayer or the metal layer on the visible light-reflecting sheet. The reflecting film may be formed by the dielectric multilayer or the metal layer. However, in terms of performance, it is desirable that the reflecting film be formed by the dielectric multilayer, which is free of absorption. This allows the reflecting film to highly exert its performance as a daylighting apparatus. In terms of cost, it is desirable that the reflecting film be formed by the metal film, which can be formed as a single layer. This allows the reflecting film to be formed at low cost.

As shown in [Table 4], for example in the case of Example 5, the proportion of the area of the portions covered by the visible light-reflecting sheets to the whole area of the second glass plate, i.e. the sheet coverage S, is 50%.

Defining Reflectance $R$×Coverage $S$ as an index of reflection intensity, $R \times S = 35\%$.

The other embodiments apply numerical values such as those shown in [Table 4]. In the case of a visible light-reflecting sheet having a low reflectance, it is preferable that the sheet coverage be high. For example, the sheet coverage may be 80%, or as in Example 8, the sheet coverage may be 100%. In a case where the sheet coverage is 100%, the step of making slits in a visible light-reflecting sheet and the subsequent step can be omitted from the after-mentioned process for manufacturing visible light-reflecting sheets. However, in a case where the sheet coverage is 100%, it is difficult to impart a sense of stripes, although a bright appearance can be achieved.

[Manufacturing Method]

A method for manufacturing a daylighting apparatus 90 of the fifth embodiment, particularly a method for manufacturing a second glass plate 12 with visible light-reflecting sheets 91 bonded thereto, is described below with reference to FIGS. 25(A) to 25(D). FIGS. 25(A) to 25(D) are plan views of the second glass plate 12 as viewed in the direction of the normal.

First, as shown in FIG. 25(A), a glass plate that is to serve as the second glass plate 12 of the daylighting apparatus, is prepared.

Next, as shown in FIG. 25(B), a visible light-reflecting sheet 91A is bonded to the whole surface of the second glass plate 12. The visible light-reflecting sheet 91A may be bonded to the second glass plate 12, for example, by using a bonding apparatus to dry-bond a visible light-reflecting sheet with an acrylic adhesive material provided on the back surface thereof or by water bonding using a water-bonding adhesive material with fine adjustments of the bonding positions.

Next, as shown in FIG. 25(C), an apparatus such as a roller cutter is used to make linear cuts K in the visible light-reflecting sheet 91A from a surface of the second glass plate 12 to which the visible light-reflecting sheet 91A was bonded.

Next, as shown in FIG. 25(D), unnecessary portions of the visible light-reflecting sheet 91A are removed from the second glass plate 12 so that visible light-reflecting sheets 91 remain in desired portions.

Further, a daylighting sheet 13 is bonded to a surface of the second glass plate 12 opposite to a surface of the second glass plate 12 on which the visible light-reflecting sheets 91 are provided. The step of bonding the daylighting sheet 13 may precede or follow the step of bonding the visible light-reflecting sheets 91.

In terms of the process of assembling the other constituent elements, the fifth embodiment is identical to the first embodiment.

As with the first to fourth embodiments, the present embodiment brings about an effect of making it possible to achieve a daylighting apparatus that gives a sense of unity to the appearance of a window with a blind installed thereon.

[First Modification of Visible Light-Reflecting Sheet]

Although the first to fifth embodiments have been described above by taking an example in which the visible light-reflecting sheet(s) impart(s) a pattern of stripes to the appearance of the daylighting apparatus, such a pattern of stripes is not a must.

Figure 26:
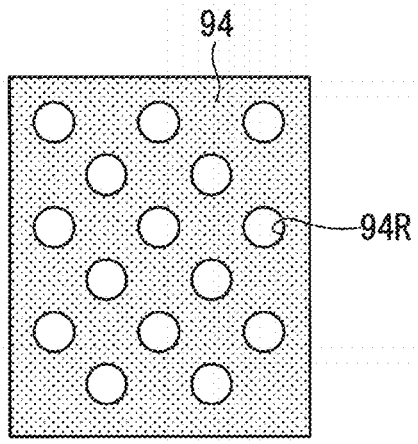
FIG. 26 is a plan view showing another example of a visible light-reflecting sheet.

As shown in FIG. 26, a visible light-reflecting sheet 94 may be provided with circular openings 94R. The visible light-reflecting sheet 94 may for example be a printed sheet such as that of the first embodiment or a semitransparent mirror sheet such as that of the fifth embodiment. The radius of each of the openings 94R ranges, for example, from approximately several millimeters to several centimeters. In a case where the visible light-reflecting sheet 94 is used, the glass plate is exposed through regions inside the openings 94R, and light is transmitted through these regions. At least part of the light is reflected by a region outside the openings 94R, i.e. a region in which the visible light-reflecting sheet 94 is present.

[Second Modification of Visible Light-Reflecting Sheet]

Figure 27:
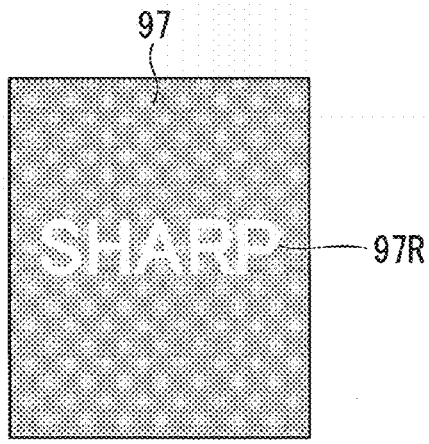
FIG. 27 is a plan view showing still another example of a visible light-reflecting sheet.

As shown in FIG. 27, another example of a visible light-reflecting sheet may be a visible light-reflecting sheet 97 provided with openings 97R representing information including characters, a logo, a picture, or the like. The visible light-reflecting sheet 97 may for example be a printed sheet such as that of the first embodiment or a semitransparent mirror sheet such as that of the fifth embodiment. As in the first modification, the glass plate is exposed through regions inside the openings 97R, and light is transmitted through these regions. At least part of the light is reflected by regions outside the openings 97R, i.e. a region in which the visible light-reflecting sheet 97 is present.

A daylighting apparatus including a visible light-reflecting sheet 94 or 97 of the first or second modification can provide a bright appearance when seen from outside of the window. This makes it possible to impart advertising effectiveness or design qualities to the window, although it is difficult, unlike in the first to fifth embodiment, to give a sense of unity with a blind by imparting a pattern of stripes to the appearance of the daylighting apparatus.

Sixth Embodiment

A sixth embodiment of the present invention is described below with reference to FIGS. 28 and 29.

A daylighting apparatus of the present embodiment is identical in basic configuration to that of the first embodiment but differs from that of the first embodiment in terms of the configuration of a visible light-reflecting sheet.

Figure 28:
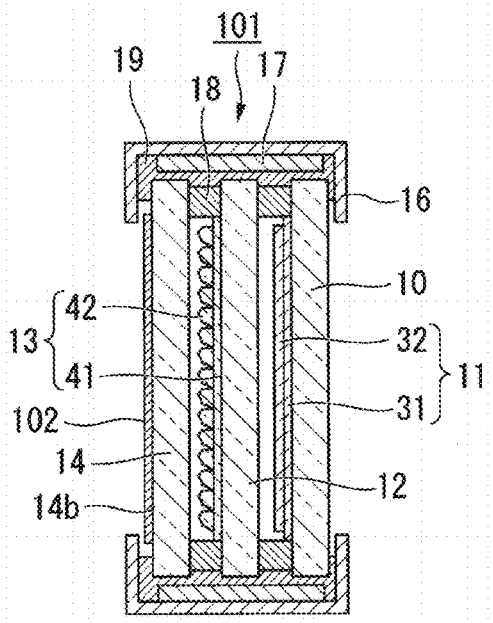
FIG. 28 is a cross-sectional view of a daylighting apparatus of a sixth embodiment.

FIG. 28 is a cross-sectional view of a daylighting apparatus of the sixth embodiment.

Figure 29:
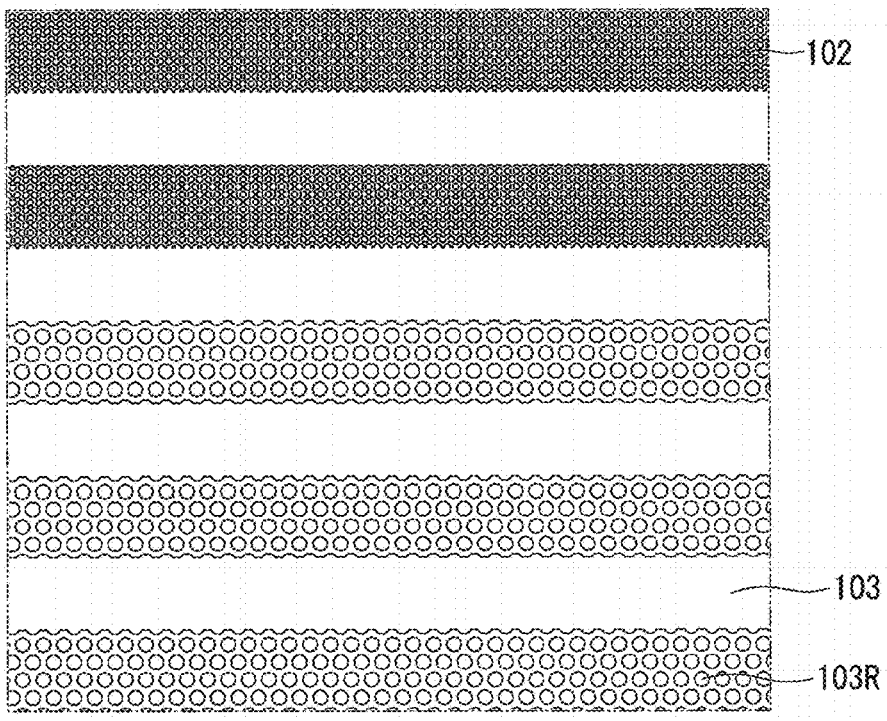
FIG. 29 is a plan view of a visible light-reflecting sheet.

FIG. 29 is a front view of a visible light-reflecting sheet.

Constituent elements shown in FIGS. 28 and 29 that are common to the drawings referred to in the first embodiment are given the same reference signs and, as such, are not described in detail.

As shown in FIG. 28, a daylighting apparatus 101 of the sixth embodiment is configured such that a visible light-reflecting sheet 102 is bonded to a second surface 14*b* (i.e. a surface that is closest to the outside of the building) of the third glass plate 14. In terms of the other components, the daylighting apparatus 101 is identical to its counterpart of the first embodiment.

As shown in FIG. 29, the visible light-reflecting sheet 102 includes a visible light-reflecting substrate 103 and a plurality of through-holes 103R provided in the substrate 103. The plurality of through-holes 103R serve as a transmitting portion that transmits light. The substrate 103 is constituted by a metal plate of aluminum or the like. The plurality of through-holes 103R of the substrate 103 are formed by punching the metal plate. The portions of the substrate 103 in which the through-holes 103R are provided transmit light, and the portions of the substrate 103 other than the through-holes 103R reflect light. This allows the visible light-reflecting sheet 102 to function as a semitransparent sheet. As shown in FIG. 29, the reflectance of the visible light-reflecting sheet 102 can be controlled with location by appropriately adjusting the size, density, and the like of the through-holes 103R. In FIG. 29, a plurality of regions differing in size and density of the through-holes 103R from each other are provided in stripes.

As with the first to fifth embodiments, the present embodiment brings about an effect of making it possible to achieve a daylighting apparatus that gives a sense of unity to the appearance of a window with a blind installed thereon.

Seventh Embodiment

A seventh embodiment of the present invention is described below with reference to FIG. 30.

A daylighting apparatus of the present embodiment is identical in basic configuration to that of the first embodiment but differs from that of the first embodiment in terms of the configuration of a reflecting member.

Figure 30:
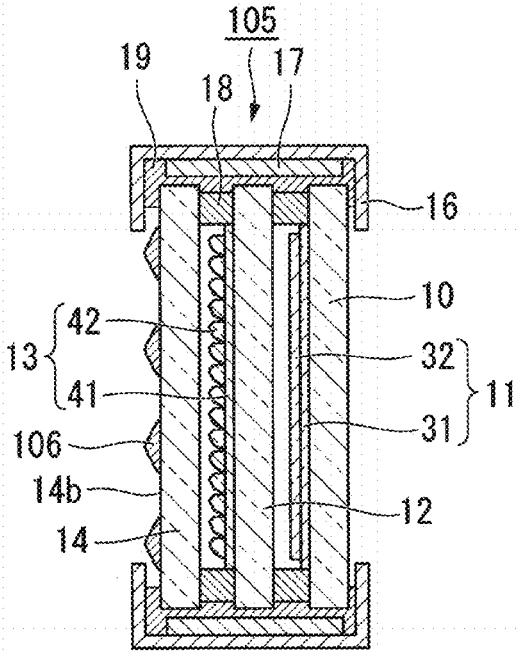
FIG. 30 is a cross-sectional view of a daylighting apparatus of a seventh embodiment.

FIG. 30 is a cross-sectional view of a daylighting apparatus of the seventh embodiment.

Constituent elements shown in FIG. 30 that are common to the drawings referred to in the first embodiment are given the same reference signs and, as such, are not described in detail.

In the first to sixth embodiments, all reflecting members are in sheet form. On the other hand, as shown in FIG. 30, a daylighting apparatus 105 of the present embodiment is configured such that a visible light-reflecting member 106 is provided on the second surface 14*b* (i.e. the surface that is closest to the outside of the building) of the third glass plate 14. The visible light-reflecting member 106 is not in sheet form but is constituted by a plurality of three-dimensional structures. For example, the structures are in prism form with given reflecting surfaces. In terms of the other components, the daylighting apparatus 105 is identical to its counterpart of the first embodiment.

As with the first to sixth embodiments, the present embodiment brings about an effect of making it possible to achieve a daylighting apparatus that gives a sense of unity to the appearance of a window with a blind installed thereon.

[Illumination Lighting Control System]

Figure 31:
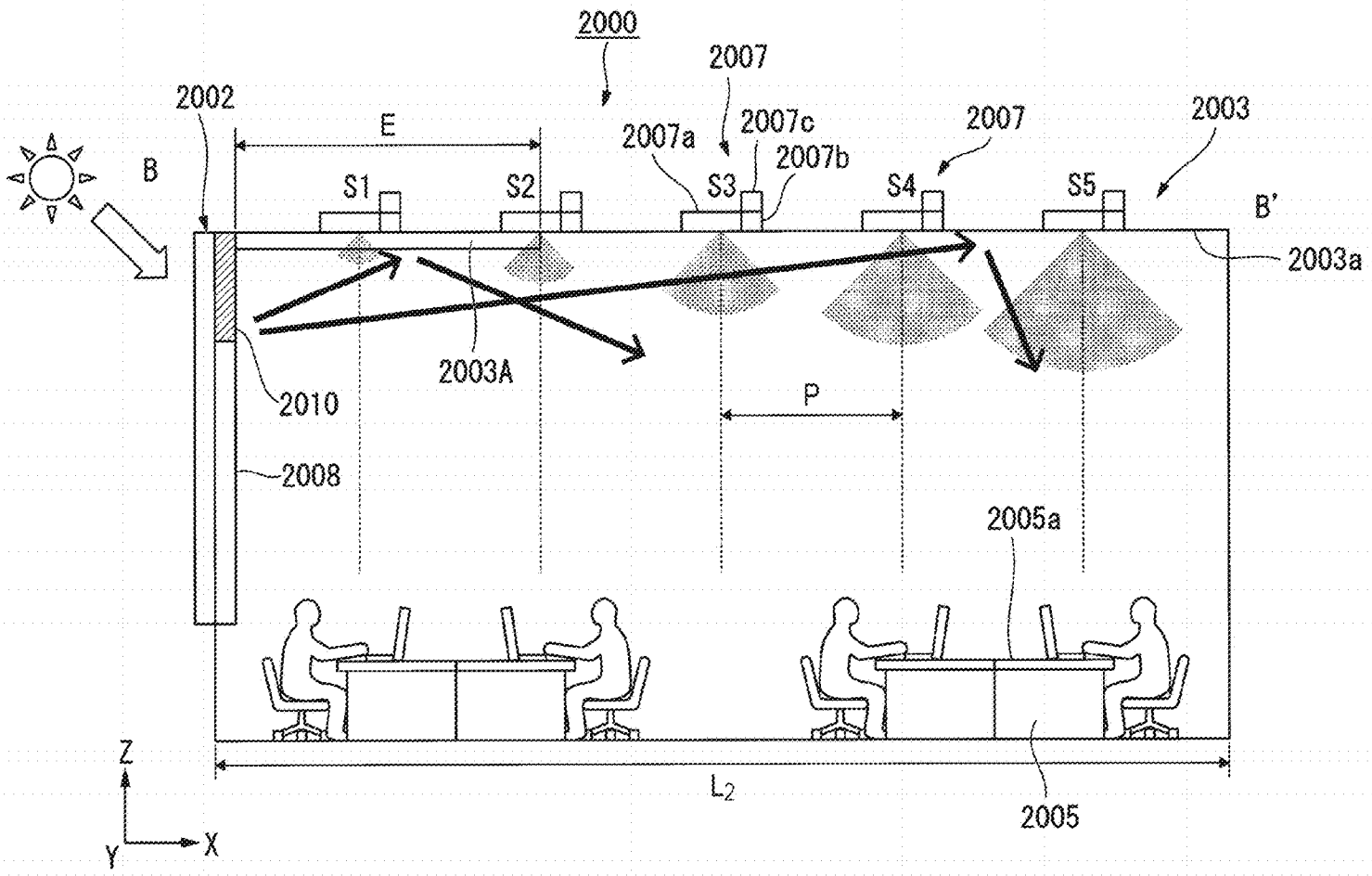
FIG. 31 is a cross-sectional view taken along line B-B' in FIG. 32 of a room model including a daylighting apparatus and an illumination lighting control system.
Figure 32:
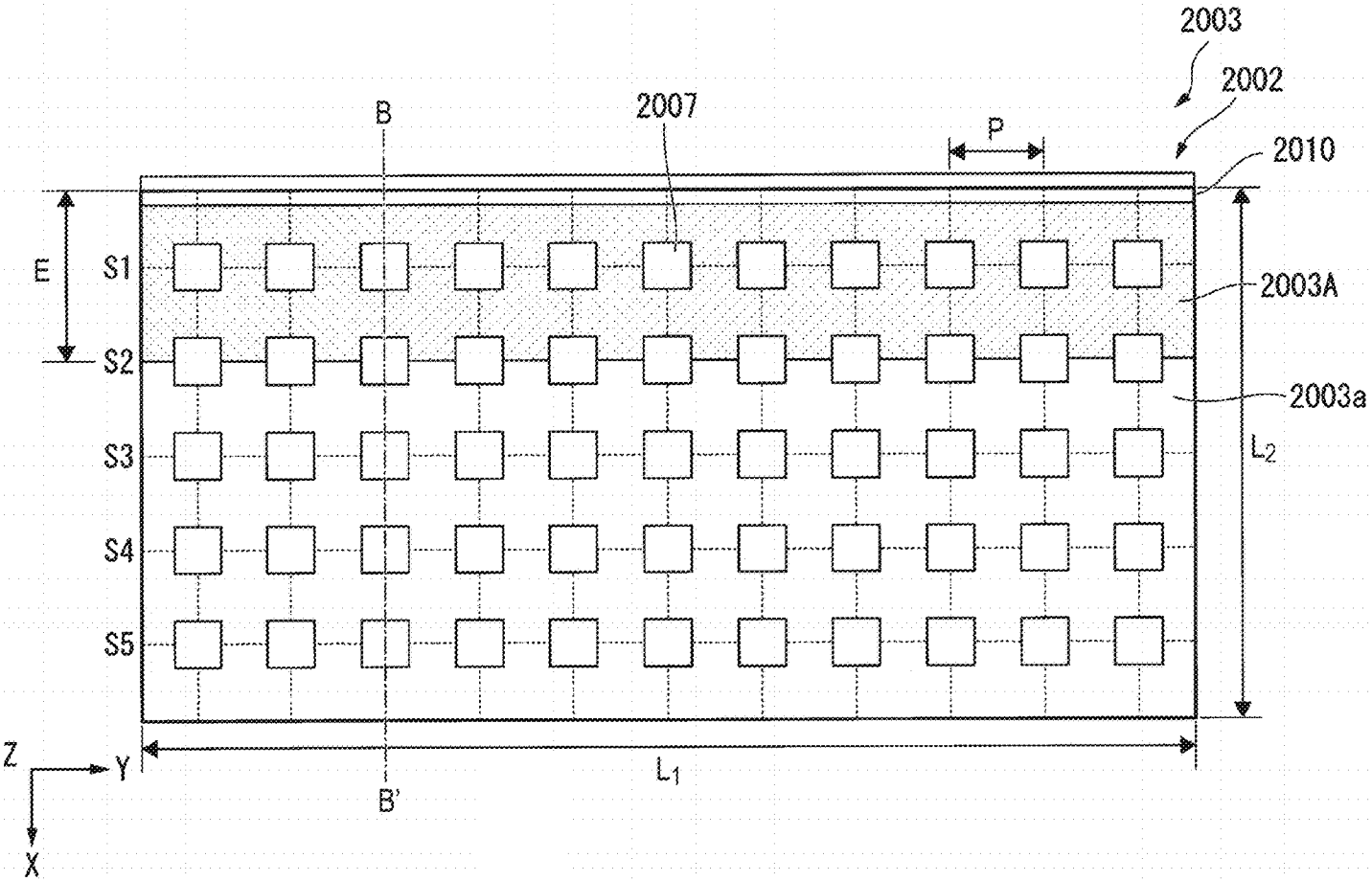
FIG. 32 is a plan view showing a ceiling of a room model.

FIG. 31 is a cross-sectional view taken along line B-B' in FIG. 32 of a room model 2000 including a daylighting apparatus and an illumination lighting control system.

FIG. 32 is a plan view showing a ceiling of the room model 2000.

In the room model 2000, a room 2003 into which outside light is introduced may have a ceiling 2003*a* constituted by a ceiling material having high light reflectivity. As shown in FIGS. 30 and 31, as the ceiling material having light reflectivity, a light reflective ceiling material 2003A is installed on the ceiling 2003*a* of the room 2003. The light reflective ceiling material 2003A is intended to facilitate the introduction of outside light into the back of the room from a daylighting apparatus 2010 installed on a window 2002. The light reflective ceiling material 2003A is installed on the ceiling 2003*a* by the window. Specifically, the light reflective ceiling material 2003A is installed in a predetermined region E (i.e. a region that is approximately 3 m away from the window 2002) on the ceiling 2003*a*.

As mentioned earlier, the light reflective ceiling material 2003A functions to effectively guide, into the back of the room, the outside light introduced into the room through the window 2002 on which the daylighting apparatus 2010 of the present invention (i.e. the daylighting apparatus according to any of the embodiments described above) is installed. The outside light introduced from the daylighting apparatus 2010 toward the ceiling 2003*a* inside the room is reflected by the light reflective ceiling material 2003A, changes its direction, and illuminates a desk top surface 2005*a* of a desk 2005 put in the back of the room, thus bringing about an effect of brightening up the desk top surface 2005*a*.

The light reflective ceiling material 2003A may be a diffuse reflective material or a specular reflective material. However, in order to bring about both an effect of brightening up the desk top surface 2005*a* of the desk 2005 put in the back of the room and an effect of reducing the glare that is unpleasant to a person who is in the room, it is preferable that the light reflective ceiling material 2003A possess an appropriate mixture of the properties of both a diffuse reflective material and a specular reflective material.

Although much of the light introduced into the room by the daylighting apparatus 2010 travels toward the ceiling near the window 2002, the amount of light is often sufficient in the vicinity of the window 2002. For this reason, combined use of such a light reflective ceiling material 2003A diverts the light having fallen on the ceiling (region E) near the window into the back of the room, where the amount of light is smaller than it is by the window.

The light reflective ceiling material 2003A may be prepared either by embossing a metal plate of aluminum or the like so that the metal plate has depressed and raised portions on the order of several tens of micrometers or by depositing a metal thin film of aluminum or the like on a surface of a similarly embossed resin substrate. Alternatively, the depressed and raised portions that are formed by the embossing may be formed by curved surfaces at larger intervals.

Furthermore, the distribution property of light and the distribution of light inside the room can be controlled by appropriately changing the embossed shapes that are formed in the light reflective ceiling material 2003A. For example, in the case of embossing in stripes that extend into the back of the room, light reflected by the light reflective ceiling material 2003A spreads in a transverse direction of the window 2002 (i.e. a direction intersecting a longitudinal direction of the depressed and raise portions). In a case where the window 2002 of the room 2003 is limited in size and orientation, such properties are utilized so that the light reflective ceiling material 2003A can diffuse the light in a horizontal direction and reflect the light toward the back of the room.

The daylighting apparatus 2010 of the present invention is used as part of the illumination lighting control system of the room 2003. The illumination lighting control system is constituted by constituent members of the whole room, for example, including the daylighting apparatus 2010, a plurality of indoor illuminating apparatuses 2007, an insolation adjusting apparatus 2008 installed on the window, a control system of these components, and the light reflective ceiling material 2003A installed on the ceiling 2003*a*.

The daylighting apparatus 2010 is installed on the upper part of the window 2002 of the room 2003, and the insolation adjusting apparatus 2008 is installed on the lower part of the window 2002 of the room 2003. Although a blind is installed as the insolation adjusting apparatus 2008 here, the isolation adjusting apparatus 2008 is not limited to this.

In the room 2003, the plurality of indoor illuminating apparatuses 2007 are arranged in gridlike fashion in the transverse direction (Y direction) of the window 2002 and the depth direction (X direction) of the inside of the room. The plurality of indoor illuminating apparatuses 2007 are combined with the daylighting apparatus 2010 to constitute the whole illuminating system of the room 2003.

FIGS. 31 and 32 show as an example the ceiling 2003*a* of an office in which the length $L_1$ of the window 2002 in the transverse direction (Y direction) is 18 m and the length $L_2$ of the room 2003 in the depth direction (X direction) is 9 m. In this example, the indoor illuminating apparatuses 2007 are arranged in gridlike fashion at intervals P of 1.8 m in both the transverse direction (Y direction) and depth direction (X direction) of the ceiling 2003*a*. More specifically, fifth indoor illuminating apparatuses 2007 are arranged in 10 columns (Y direction) and five rows (X direction).

Each of the indoor illuminating apparatuses 2007 includes an indoor illuminator 2007*a*, a brightness detecting section 2007*b*, and a control section 2007*c*, and the brightness detecting section 2007*b* and the control section 2007*c* are integrated with the indoor illuminator 2007*a*.

Each of the indoor illuminating apparatuses 2007 may include a plurality of the indoor illuminators 2007*a* and a plurality of the brightness detecting sections 2007*b*. Note, however, that the brightness detecting sections 2007*b* are provided one by one for each separate indoor illuminator

2007*a*. Each of the brightness detecting sections 2007*b* receives light reflected by an irradiated surface illuminated by the corresponding indoor illuminator 2007*a* and detects the illuminance of the irradiated surface. In this example, the illuminance of the desk top surface 2005*a* of the desk 2005 put in the room is detected by the brightness detecting section 200*b*.

The control sections 2007*c* provided one by one for each separate indoor illuminating apparatus 2007 are connected to each other. The mutual connection between the control sections 2007*c* allows each of the indoor illuminating apparatuses 2007 to perform feedback control to adjust the optical output of an LED lamp of a corresponding indoor illuminator 2007*a* so that the illuminance of the desk top surface 2005*a* as detected by the corresponding brightness detecting section 2007*b* becomes a given target illuminance L0 (e.g. an average illuminance of 750 lx).

Figure 33:
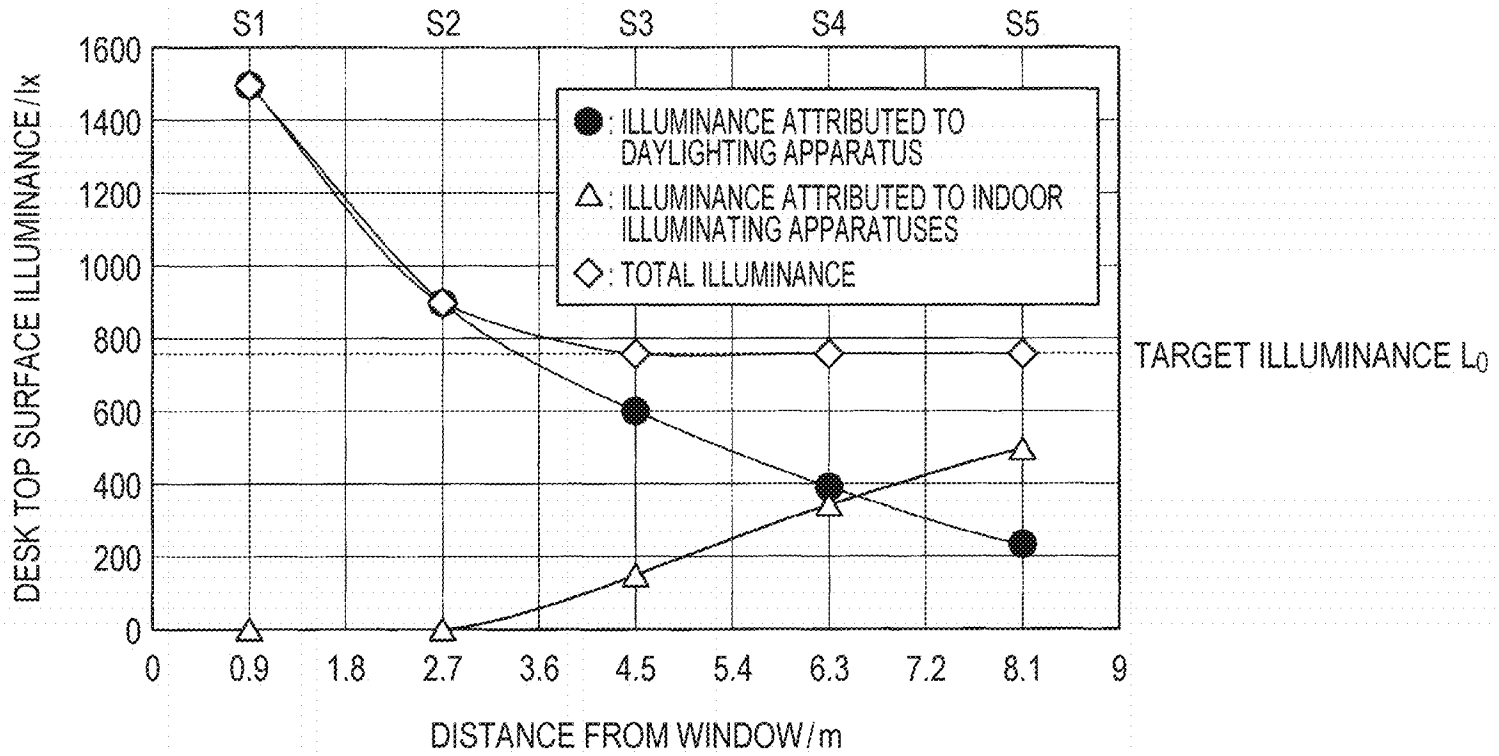
FIG. 33 is a graph showing a relationship between the illuminance of light (natural light) let into a room by a daylighting apparatus and the illuminance (illumination lighting control system) attributed to indoor illuminating apparatuses.

FIG. 33 is a graph showing a relationship between the illuminance of light (natural light) let inside the room by the daylighting apparatus and the illuminance (illumination lighting control system) attributed to the indoor illuminating apparatuses. In FIG. 33, the vertical axis represents the illuminance (lx) of the desk top surface, and the horizontal axis represents the distance (m) from the window. Further, in FIG. 33, the dotted line indicates the target illuminance inside the room. (●: Illuminance attributed to the daylighting apparatus, Δ: Illuminance attributed to the indoor illuminating apparatuses, ◇: Total illuminance)

As shown in FIG. 33, the desk top surface illuminance attributed to the light let in by the daylighting apparatus 2010 becomes higher toward the vicinity of the window and becomes smaller in effect with distance from the window. In a room to which the daylighting apparatus 2010 of the present invention is applied, natural daylighting through the window during the daytime yields such a distribution of illuminance in a direction toward the back of the room. Accordingly, the daylighting apparatus 2010 of the present invention is used in combination with the indoor illuminating apparatuses 2007, which compensate for the distribution of illuminance inside the room. The indoor illuminating apparatuses 2007 installed on the ceiling inside the room light under such lighting control that average illuminances below the apparatuses are detected by the brightness detecting sections 2007*b*, respectively, and the desk top surface illuminance of the whole room becomes the given target illuminance L0. Therefore, the rows S1 and S2 installed in the vicinity of the window hardly light, and the rows S3, S4, and S5 light with higher outputs toward the back of the room. As a result, the desk top surface of the room is illuminated by the total of the illuminance attributed to natural daylighting and the illuminance attributed to the indoor illuminating apparatuses 2007, so that a desk top surface illuminance of 750 lx, which is believed to be sufficient for work across the whole room, can be achieved. (Recommended maintenance illuminance in office, "JIS Z9110 General rules of recommended lighting levels").

As mentioned above, combined use of the daylighting apparatus 2010 and the illumination lighting control system (indoor illuminating apparatuses 2007) allow light to reach the back of the room, thus making it possible to further increase the brightness of the inside of the room and ensure a desk top surface illuminance believed to be sufficient for work across the whole room. This provides a more stable bright light environment regardless of seasons or weathers.

The present invention is not limited in technical scope to the embodiments described above, but may be modified in various ways, provided such modifications do not depart from the spirit of the present invention.

For example, although the embodiments have been described above by taking an example of a daylighting apparatus configured such that a visible light-reflecting sheet, a daylighting sheet, and a light-diffusing sheet are bonded to glass plates, respectively, and these glass plates are housed in a frame, a daylighting apparatus is not necessarily limited to this configuration. A daylighting apparatus does not need to include a frame but may take the form of a roll screen or the like that is suspended from a ceiling by using a given supporting member.

Although the embodiments have been described above by taking an example of a configuration in which a daylighting apparatus is installed on an indoor side of a window pane, a daylighting apparatus may be housed, for example, in an internal space of double-glazed glass constituting a window pane. In addition, specific configurations related to the number, placement, shapes, dimensions, materials, and the like of each of the constituent elements constituting a daylighting apparatus can be changed as appropriate.

INDUSTRIAL APPLICABILITY

The preset invention is applicable to a daylighting apparatus for letting outside light such as sunlight into a room.

REFERENCE SIGNS LIST

2, 61, 64, 67, 90, 101, 105 Daylighting apparatus
11 Light-diffusing sheet (light-diffusing member)
13, 69 Daylighting sheet (daylighting member)
15, 80, 91, 94, 97, 102 Visible light-reflecting sheet (reflecting member)
16 Frame
41 Film substrate (first substrate)
42 Daylighting portion
43 Void part
51 Substrate
54, 68 Visible light-reflecting layer (reflecting portion)
106 Visible light-reflecting member (reflecting member)

The invention claimed is:

1. A daylighting apparatus comprising:
a daylighting member that allows transmittance of external visible light from an incident surface through an emitting surface at a predetermined distribution of angles, the daylighting member comprising:
a first substrate;
a plurality of daylighting portions arrayed, in one direction, on an incident surface of the first substrate; and
a void part provided between the plurality of daylighting portions; and
a reflecting member comprising a predetermined pattern that reflects part of the visible light and transmits another part of the visible light falling on the incident surface of the daylighting member; wherein
the reflecting member is provided to oppose at least part of the incident surface of the daylighting member.

2. The daylighting apparatus according to claim 1, wherein the reflecting member further has a function of transmitting the visible light.

3. The daylighting apparatus according to claim 2, wherein the reflecting member has a reflectance that varies, in one in-plane direction, the reflectance varying in a period which is from 20 mm to 40 mm.

4. The daylighting apparatus according to claim 3, wherein there is a coincidence between a first direction in which the reflectance varies in the period and a second direction in which the plurality of daylighting portions are arrayed.

5. The daylighting apparatus according to claim 2, wherein the reflecting member includes:

a reflection region that reflects the visible light; and a transmission region that transmits the visible light.

6. The daylighting apparatus according to claim 5, wherein the reflecting member comprises:

a visible light-transmitting substrate; and a plurality of reflecting portions provided all over the visible light-transmitting substrate.

7. The daylighting apparatus according to claim 6, wherein the plurality of reflecting portions are constituted by reflective ink printed all over the visible light-transmitting substrate.

8. The daylighting apparatus according to claim 5, wherein the reflecting member comprises:

a visible light-reflecting substrate; and a plurality of transmitting portions provided in the visible light-reflecting substrate.

9. The daylighting apparatus according to claim 8, wherein the plurality of transmitting portions are constituted by a plurality of through-holes provided in the visible light-reflecting substrate.

10. The daylighting apparatus according to claim 2, wherein the reflecting member is constituted by a semi-transmissive member that reflects part of the visible light and transmits part of the visible light.

11. The daylighting apparatus according to claim 1, wherein the reflecting member is provided in contact with the incident surface of the daylighting member.

12. The daylighting apparatus according to claim 1, the daylighting apparatus further comprising:

a frame that houses the daylighting member and the reflecting member.

13. The daylighting apparatus according to claim 1, the daylighting apparatus further comprising:

a light-diffusing member provided toward the emitting surface of the daylighting member, the light-diffusing member diffusing the light having exited through the emitting surface of the daylighting member.

14. The daylighting apparatus according to claim 1, wherein the void part is provided not only between the plurality of daylighting portions but also between the plurality of daylighting portions and the reflecting member.

15. The daylighting apparatus according to claim 1, wherein the reflecting member comprises a plurality of patterns having different areas such that the observer recognizes the predetermined pattern by reflecting, by the plurality of patterns, the part of the visible light.

16. The daylighting apparatus according to claim 15, wherein each shape of the plurality of patterns is one of circular or quadrangular.

17. A daylighting apparatus comprising:

a daylighting member that has first and second surfaces opposite to each other and that lets light in through the first surface and lets the light out through the second surface at a predetermined distribution of angles, the daylighting member comprising:

a first substrate having third and fourth surfaces opposite to each other, the third surface being at a side of the first surface, the fourth surface being at a side of the second surface;

a plurality of daylighting portions arrayed, in one direction, on the third surface; and a void part provided between the plurality of daylighting portions; and a reflecting member that reflects part of visible light so as to be recognized by an observer as a predetermined pattern, and transmits another part of the visible light falling on the first surface, wherein the reflecting member further has a function of transmitting the visible light, wherein the reflecting member has a reflectance that varies, in one in-plane direction, the reflectance varying in a period which is from 20 mm to 40 mm, and there is a coincidence between a first direction in which the reflectance varies in the period and a second direction in which the plurality of daylighting portions are arrayed.

18. A daylighting apparatus comprising:

a daylighting member that has first and second surfaces opposite to each other and that lets light in through the first surface and lets the light out through the second surface at a predetermined distribution of angles, the daylighting member comprising:

a first substrate having third and fourth surfaces opposite to each other, the third surface being at a side of the first surface, the fourth surface being at a side of the second surface;

a plurality of daylighting portions arrayed, in one direction, on the third surface; and a void part provided between the plurality of daylighting portions; and a reflecting member that reflects part of visible light so as to be recognized by an observer as a predetermined pattern, and transmits another part of the visible light falling on the first surface, wherein the reflecting member comprises a plurality of patterns having different areas such that the observer recognizes the predetermined pattern by reflecting, by the plurality of patterns, the part of the visible light, wherein each shape of the plurality of patterns is one of circular or quadrangular.

* * * * *